US006118952A

United States Patent [19]

Furuya

[11] Patent Number: 6,118,952

[45] Date of Patent: Sep. 12, 2000

[54] IMAGE FORMING APPARATUS THAT DETECTS IMAGE FORMING CONDITION

[75] Inventor: Tadashi Furuya, Susono, Japan

[73] Assignee: Canon Kabushiki Kaisha, Tokyo, Japan

[21] Appl. No.: 08/811,595

[22] Filed: Mar. 4, 1997

[30] Foreign Application Priority Data

| | | | |
|---|---|---|---|
| Mar. 4, 1996 | [JP] | Japan | 8-045881 |
| May 20, 1996 | [JP] | Japan | 8-148610 |
| May 13, 1996 | [JP] | Japan | 8-142231 |

[51] Int. Cl.[7] ..... G03G 15/02; G03G 15/24

[52] U.S. Cl. ..... 399/50; 361/225; 399/150; 399/175

[58] Field of Search ..... 399/24, 25, 26, 399/168, 174–176, 159, 150, 9, 50; 361/221, 225

[56] References Cited

U.S. PATENT DOCUMENTS

| | | | |
|---|---|---|---|
| 5,160,967 | 11/1992 | Tonegawa | 399/26 |
| 5,182,604 | 1/1993 | Asai | 399/168 |
| 5,278,612 | 1/1994 | Inui | 399/26 |
| 5,471,283 | 11/1995 | Irihara et al. | 399/168 X |
| 5,548,374 | 8/1996 | Iguchi et al. | 399/24 |
| 5,587,774 | 12/1996 | Nagahara et al. | 399/176 |
| 5,652,803 | 7/1997 | Tachikawa et al. | 399/9 X |
| 5,659,852 | 8/1997 | Chigono et al. | 399/175 |
| 5,666,192 | 9/1997 | Mashimo et al. | 399/174 |
| 5,708,915 | 1/1998 | Noguchi et al. | 399/50 X |
| 5,757,508 | 5/1998 | Murata | 399/168 X |
| 5,890,037 | 3/1999 | Kukimoto et al. | 399/175 |

FOREIGN PATENT DOCUMENTS

| | | |
|---|---|---|
| 7-20675 | 1/1995 | Japan . |

*Primary Examiner*—Susan S. Y. Lee

*Attorney, Agent, or Firm*—Fitzpatrick, Cella, Harper & Scinto

[57] ABSTRACT

An image forming apparatus has an image forming unit for forming a toner image on a recording material, the image forming unit including an image bearing member for bearing a toner image, and a charging device provided with a magnetic particle layer contactable to the image bearing member to charge the image bearing member; and a determining device for determining an image forming condition of the image forming unit in accordance with a physical quantity relating to a toner amount introduced in the magnetic particle layer or deciding prohibition of the image forming operation of the image forming unit.

56 Claims, 14 Drawing Sheets

IMAGE FORMING APPARATUS THAT DETECTS IMAGE FORMING CONDITION

FIELD OF THE INVENTION AND RELATED ART

The present invention relates to an image forming apparatus provided with a charging device contactable to an image bearing member to charge an image bearing member.

An electrophotographic apparatus is known wherein an image bearing member such as a photosensitive member is charged by a magnetic brush contact charging device. The contact charging device has an advantage that amount of the ozone product is smaller than a corona discharger.

However, the contact charging involves a problem that if the toner particles are introduced into the magnetic brush, the charging property of the charging device is deteriorated, since the magnetic particles forming the magnetic brush are electroconductive, whereas the toner particles of the toner image formed on the image bearing member, is insulative.

Particularly, when the cleaning for removing residual toner from the photosensitive member after image transfer is not used for purpose of downsizing of the image forming apparatus, and such toner is removed by the developing device, then amount of the introduced toner is large since a large amount of the toner reaches the charging position of the charging device. In the case that residual toner is temporarily collected from the photosensitive member by the charging device, the toner mixing amount is further large with the result of remarkable deterioration of the charging property. The amount of introduced toner varies depending on image forming conditions, and the charging property is different depending on the amount of introduced toner.

In an injection charging type wherein the charge is directly injected into the photosensitive member, a contact charging device directly injects the charge into the charge injection layer provided at the photosensitive member surface. Therefore, the deterioration of the charging property resulting from the toner introduction is more significant than in the normal charging type using electric discharge.

The deterioration of the charging property results in image defect in the resultant image.

SUMMARY OF THE INVENTION

Accordingly, it is a principal object of the present invention to provide an image forming apparatus wherein deterioration of the charging property due to introduction of the toner into the charging device.

It is another object of the present invention to provide an image forming apparatus wherein the image defect due to introduction of the toner into the charging device is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present Invention will be described.

First Embodiment

This example relates to an image forming apparatus wherein an untransferred toner is at least temporarily collected in a magnetic brush charging device, and a toner amount in the magnetic brush is predicted or estimated on the basis of a current through the magnetic brush charging device, and the setting of the image or forming process condition of the image forming apparatus is changed.

Figure 1:
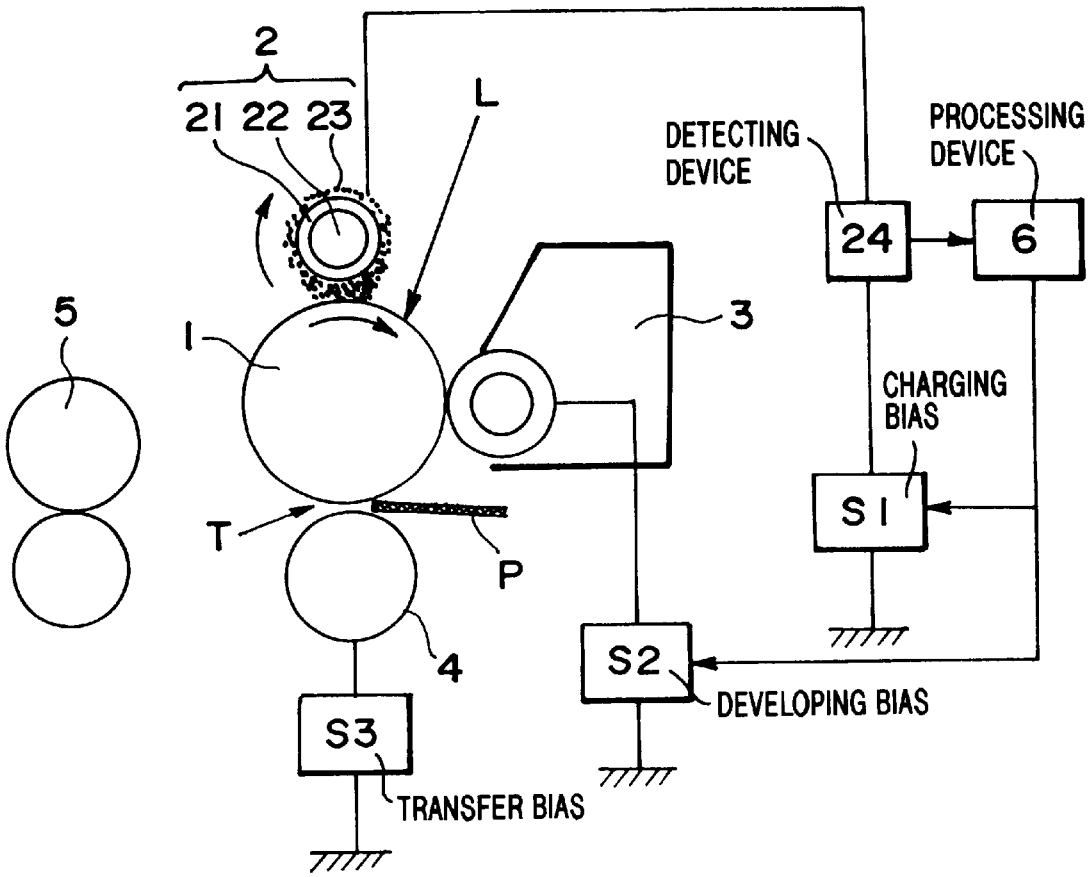
FIG. 1 is a schematic illustration of an image forming apparatus according to an embodiment of the present invention.
Figure 2:
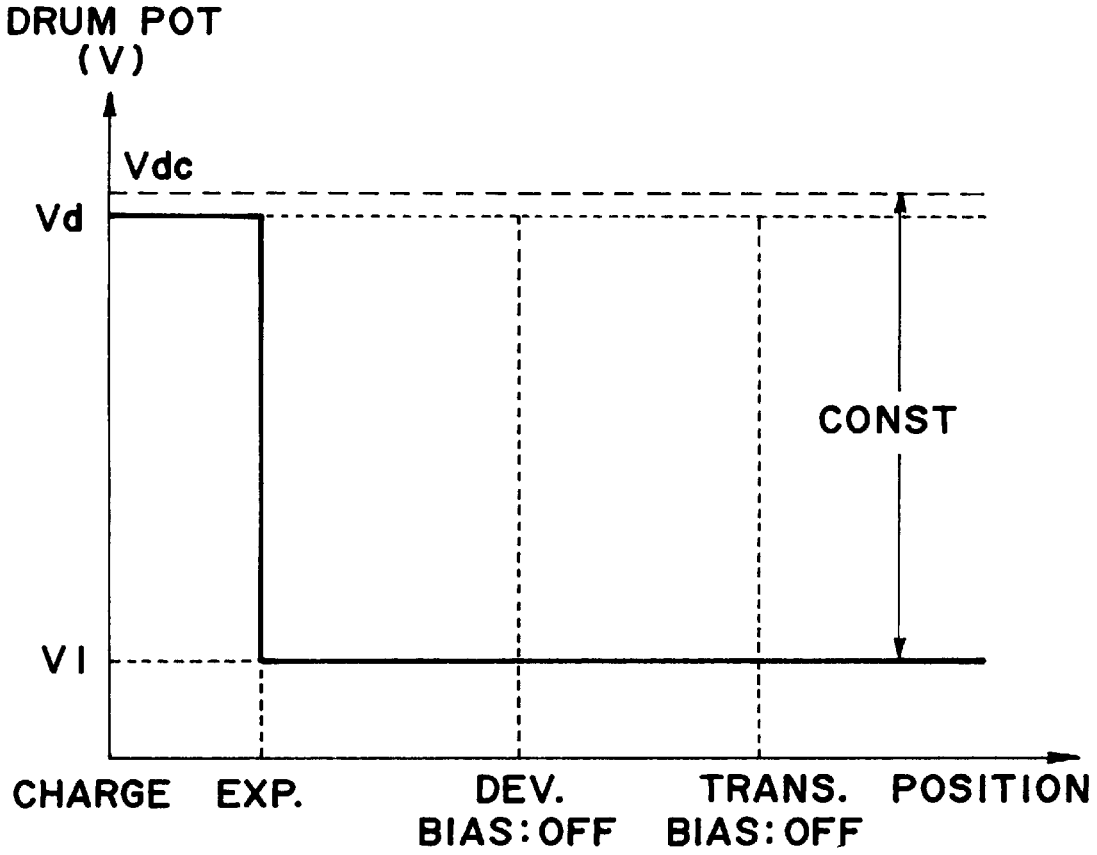
FIG. 2 is a graph showing a photosensitive member potential obtained by charging current measurement in a first embodiment.

FIG. 1 is a schematic illustration of an image forming apparatus according to an embodiment of the present invention. The image forming apparatus in this example is a laser beam printer using an electrophotographic process.

Designated by 1 is an electrophotographic photosensitive member of a rotatable drum type as an image bearing member. The photosensitive member 1 is rotated in the clockwise direction indicated by the arrow. The photosensitive drum 1 comprising an electroconductive base of metal or the like which is electrically grounded, and a photosensitive layer.

In this example, the photosensitive layer is an organic photoconductive layer having a negative charging polarity.

Designated by 2 is a contact charging device using a magnetic brush contacted to the photosensitive member 1, and it comprises a rotatable non-magnetic electrode sleeve 21, a magnet 22, and an electroconductive magnetic particles 23 deposited on the sleeve by the magnetic force of the magnet 22. The sleeve 21 for the magnetic brush 2 is supplied with a charging bias voltage comprising a DC bias(negative polarity) and an AC bias superposed thereon from a charging bias applying voltage source S1 to uniformly charge the outer peripheral surface of the photosensitive member 1. Between the magnetic brush charging device and the charging bias electrode S1, a detecting device 24 for detecting a current through the magnetic brush, is provided, and a process condition for image formation is changed in accordance with the current detected thereby. The volume resistivity of the magnetic particle 23 is preferably $1\times10^5$–$1\times10^8$ Ωcm.

The charged surface of the photosensitive member 1 is exposed to scanning exposure L emitted from a laser beam modulated in the intensity, corresponding to the pixel signal, so that electrostatic latent image is formed on the peripheral surface of the rotatable photosensitive member 1 in accordance with the intended image information. The electrostatic latent image is developed into a toner image with an insulative toner(negative charging polarity) by a developing bias applied from the developing bias applying voltage source S2.

The volume resistivity of the toner is preferably not less than $\mathbf{1\times10^{15}}$ Ωcm.

On the other hand, a transfer material P as a recording material is supplied from an unshown sheet feeding station, and is introduced at a predetermined timing into a nip (transfer portion)T formed between the photosensitive member 1 and a transfer roller 4 as a contact type transferring means which is contacted thereto at a predetermined pressure and which has an intermediate resistance. To the transfer roller 4, a transfer bias voltage(positive polarity) of the polarity opposite from that of the toner is applied from a transfer bias application voltage source S3, so that charge of the polarity opposite from that of the toner charge is applied to the back side of the transfer material.

The transfer material P introduced to the transfer portion T is passed through the nip, and the toner image is continuously transferred from the surface of the photosensitive member 1 onto the transfer material P by the electrostatic force and the pressure. The residual toner remaining on the photosensitive member after the image transfer is partly charged to the positive polarity by the transfer charging.

The transfer material P now having the toner image, is separated from the surface of the photosensitive member 1, and is fed to a heat fixing type fixing device 5, where the toner image is fixed on the transfer material P. Finally, it is discharged as a print.

The surface of the photosensitive member after the toner image transfer to the transfer material P, reaches the position where it is contacted to the magnetic brush charging device 2, while carrying the untransferred toner. By the magnetic brush charging device 7, the untransferred toner is partly taken up by sliding force and the charging bias(negative) of the magnetic brush, so that surface is cleaned to be used again for the image formation. Among the residual toner after the transfer, those charged to the negative polarity, passes through the contact portion, but those charged to the positive polarity is attracted into the magnetic brush. The photosensitive member region having the untransferred toner is charged by the charging device, and then, is exposed to an image so that latent image is formed.

The untransferred toner introduced into the magnetic brush charging device 2, is charged by the friction with the magnetic particles 23 to the negative polarity which is the normal charging polarity, and is discharged uniformly onto the surface of the photosensitive member, and is then collected by the developing device 3 at a developing station to be reused for the development. The developing bias of the developing device is so selected that negative residual toner is removed, while the normal is effected. More particularly, it is selected to be between the dark portion potential and the light portion potential, by which an electric field is formed in such a direction that toner is deposited from the developing sleeve to the light potential portion, whereas the toner returns from the dark potential portion to the developing sleeve. The polarity of the untransferred toner is uniformed to the normal negative polarity by the charging device 2, so that pattern of the untransferred toner is removed, thus preventing production of the of(remaining image).

The description will be made as to a device for detecting a physical quantity relating to the toner amount to predict the toner amount in the magnetic brush charging device used in this example.

The magnetic brush charger of this example comprises, as shown in FIG. 1, a rotatable non-magnetic electrode sleeve 21, a magnet 22, and magnetic particles 23 deposited by the magnetic force on the sleeve.

The magnetic brush charging device 2 is supplied with the charging bias in the form of the DC voltage biased with the AC bias voltage from the charging bias applying voltage source S1, and the detecting device 24 is provided between the magnetic brush charging device 2 and the charging bias voltage source S1 to detect the DC current through the magnetic brush.

In order to detect the resistance of the magnetic brush correctly, the potential difference between the magnetic brush and the photosensitive member 1 is made constant. During the image formation, the potential difference from the photosensitive member is not constant because of the change of the image ratio and/or the transfer voltage. Therefore, the current detection is not carried out during the image forming operation, and is carried out when the image is not formed, with the potential of the photosensitive member being kept constant. In this example, the photosensitive member is subjected to a whole surface exposure to uniform laser beam L when the image forming operation is not carried out, and the developing bias applying voltage source S2 and the transfer bias application voltage source S3 are rendered off, and a predetermined voltage Vdc is applied to the sleeve 21, while the light portion potential of the photosensitive member is V1. The DC current supplied to the sleeve 21 is then measured.

Figure 3:
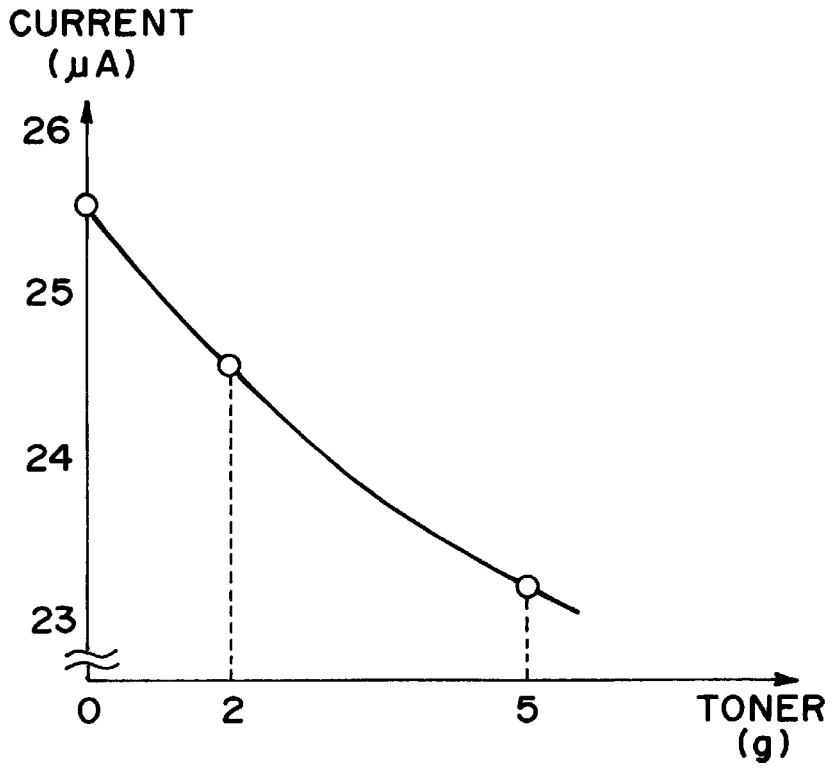
FIG. 3 is a graph of a relation between the toner amount in the magnetic brush charging device and the current in the first embodiment.

The measured current(a physical quantity relating to the toner amount) is compared with a relation, as shown in FIG. 3, between the toner amount in the magnetic brush charging device and the current, which relation has been measured beforehand. And, the toner amount in the magnetic brush charging device 2 is determined therein as the toner amount for the measured potential difference(Vdc−V1).

In accordance with the toner amount thus determined, a processing device 6 determines an image forming process conditions such as the charging bias and developing bias, and changes the process conditions accordingly. In this example, when the amount of the toner is in the magnetic brush charging device 2, the image forming operation of the main assembly is prohibited, and a warning signal is produced to a user.

When the number of prints increases, the amount of introduced toner in the magnetic brush charging device 2 increases, and if the voltage applied to the electrode sleeve is constant, the improper charging occurs with the result of defective image formed. This problem is overcome in this embodiment, since the main assembly operation is stopped if the charging property is deteriorated.

In this example, the charging bias is in the form of an AC biased DC voltage, and the discharging thereby is used. However, the present invention is not limited to a particular charging type, and is applicable to a magnetic brush charging device of any injection charging type wherein the charge is directly injected into a charge injection layer of a photosensitive member.

Figure 4:
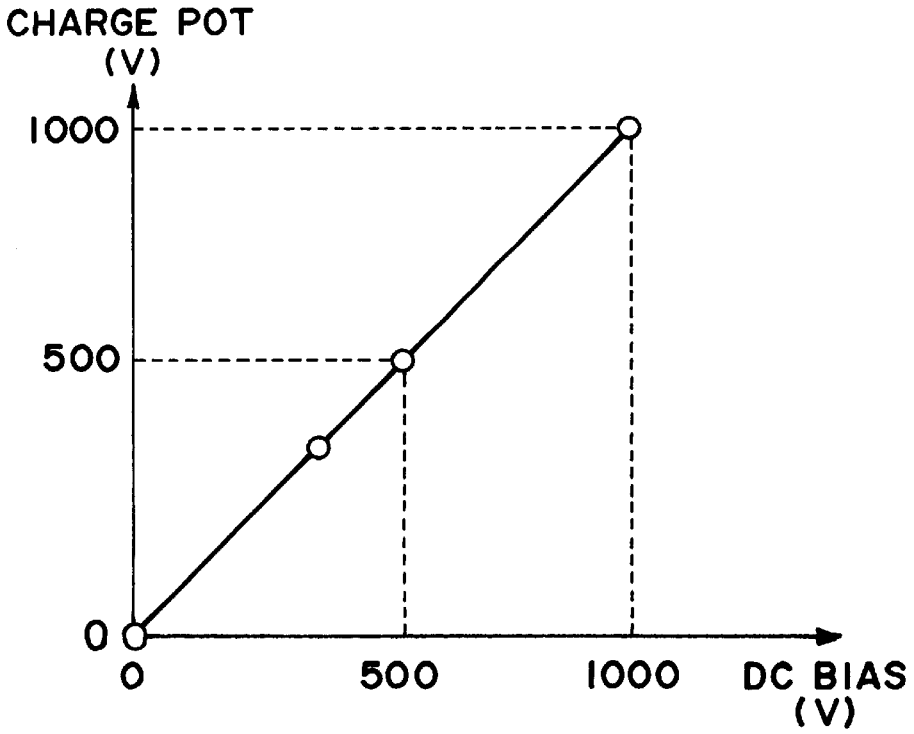
FIG. 4 is a graph showing a relation between an applied voltage and a surface potential of the photosensitive member in an injection charging type.

In the injection charging type, the charge injection is directly effected by a contact charging member having an intermediate resistance into the photosensitive member surface not through discharge phenomenon. Therefore, the photosensitive member is charged to a potential corresponding to the applied voltage to the charging member, even if the applied voltage is lower than the discharge threshold. A relation between the applied voltage and the surface potential of the photosensitive member is shown in FIG. 4 (when the toner is not introduced into the charger).

The charge injection layer in this example is produced as follows. $SnO_2$ particles having a particle size of approx. 0.03 $\mu$m made electroconductive by antimony-doping, are dispersed in photo-curing type acrylic resin material at 5:2 parts by weight, and 3 parts by weight of Teflon particles having a particle size of 0.5 $\mu$m are added thereto. The material thus produced is applied on the OPC photosensitive layer through dip coating method. The thickness thereof is 3 $\mu$m.

If the resistance value is too low, the image is blurred due to lateral flow of the latent image charge along the surface, and if it is too high, the charge injection into the charge injection layer is difficult. The volume resistivity of the charge injection layer is preferably in the range of $1\times10^{10}$–$1\times^{10}14$ Ωcm, and is further preferably $1\times10^{12}$–$1\times10^{13}$ Ωcm under the normal temperature and normal humidity condition (23.5° C., 60%), if the resistance change under high temperature and high humidity and low temperature low humidity conditions are taken into account.

The volume resistivity of the charge injection layer is measured, using a sample thereof in the form of a sheet and a HIGH RESISTANCE METER 4329A (available from Yokogawa Hewlett-Packard Kabushiki Kaisha, Japan) connected to a RESISTIVITY CELL 16008A. with a voltage of 100V applied.

The control of this example can be used with such an injection charging type image forming apparatus by measuring the DC current through the magnetic brush charging device.

As described in the foregoing, according to this example, there is provided an image forming apparatus wherein the untransferred toner is at least temporarily collected by the magnetic brush charging device, the toner amount in the magnetic brush is predicted on the basis of the current through the magnetic brush charging device, and in accordance with the predicted toner amount, the image forming process condition of the image forming apparatus is changed, or the image forming operation is prohibited, so that production of defective image due to the deterioration of the charging performance, can be prevented beforehand.

Second Embodiment

This example provides an image forming apparatus wherein the untransferred toner is at least temporarily collected by a magnetic brush charging device, wherein a cleaning bias is applied to the magnetic brush charging device so as to returns a part of toner from the charging device to the photosensitive member, and a toner content on the photosensitive member at this time(a physical quantity relating to the amount of introduced toner) is measured. The toner amount in the magnetic brush is predicted on the basis of the measurement, and the process condition of the image forming apparatus is set in accordance with the prediction, or the image forming operation is prohibited.

Figure 5:
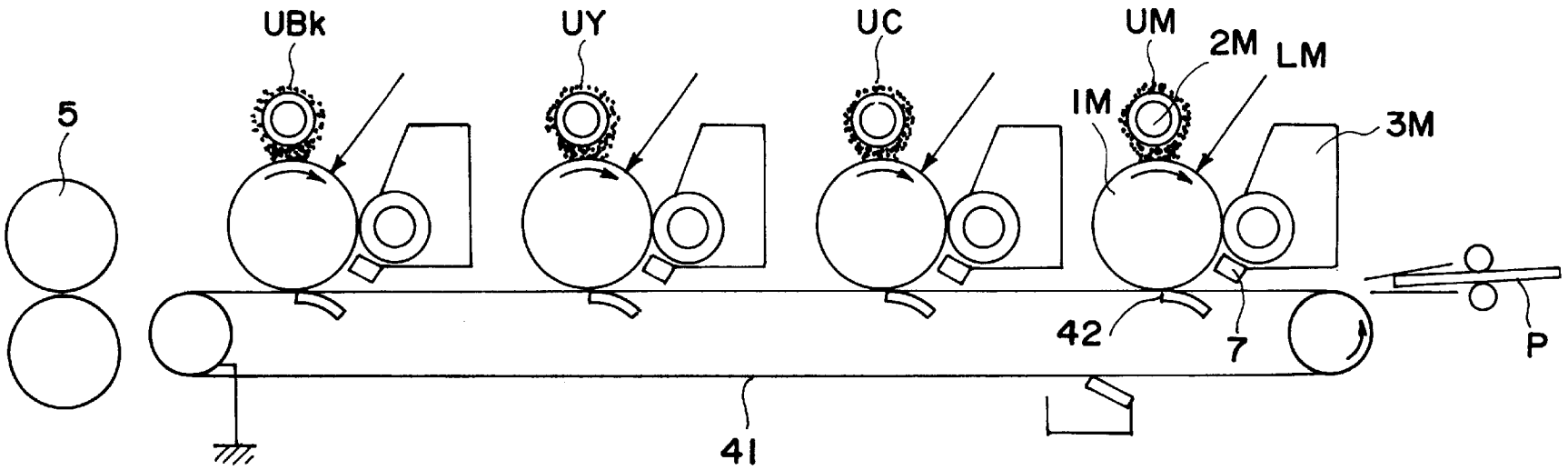
FIG. 5 is a schematic illustration of an example of color image forming apparatus according to an embodiment of the present invention.

FIG. 5 is a schematic illustration of an image forming apparatus according to an embodiment of the present invention. In this example, the image forming apparatus is a color image forming apparatus using an electrophotographic process.

The color image forming apparatus of this example is provided with a plurality of photosensitive members for the purpose of high speed color image output, wherein a transfer material is fed by a feeding means in the form of a belt, and the toner images are sequentially transferred superimposedly on the transfer material. An image forming unit is constituted by a photosensitive member, the magnetic brush charging device, an image exposure device and a developing device, and the untransferred toner is at least temporarily collected by the magnetic brush charging device. The structures are quite similar to those of the first embodiment.

The image forming unit forms color images using 4 units for magenta toner(UM), cyan toner((UC), yellow toner (UY), and black toner(UBk).

In the image forming unit for (magenta)UM, a photosensitive member 1M is rotated in the clockwise direction indicated by an arrow, and the outer peripheral surface of the photosensitive member 1M is uniformly charged by a magnetic brush charging device 2M contacted to the surface.

The surface of the photosensitive member 1M thus charged is exposed to laser beam LM modulated in accordance with a pixel signal for the magenta color provided by color separation of a color image, so that electrostatic latent image is formed on the peripheral surface of the photosensitive member 1M, corresponding to the image information for the magenta color. The electrostatic latent image is developed into a magenta toner image by a developing device 3M containing insulative magenta toner.

The similar process is carried out in each of the units for cyan UC, yellow unit UY, black unit UBk, so that toner images are formed, corresponding to the image information for each color.

On the other hand, a transfer material P as a recording material is supplied from an unshown sheet feeding station, and is carried on a transfer belt 41. The toner images are sequentially transferred superimposedly on the transfer material P by transfer blades 42 sandwiching the transfer belt 41 with the photosensitive member 1.

The transfer material P now having the toner image, is separated from the surface of the photosensitive member 1, and is fed to a heat fixing type fixing device 5, where the toner image is fixed on the transfer material P. Finally, it is discharged as a print.

The surface of each of the photosensitive members after the toner image transfer to the transfer material P, reaches the position where it is contacted to the magnetic brush charging device 2, while carrying the untransferred toner. By the magnetic brush charging device 2, the untransferred toner is partly taken up by sliding force and the charging bias(negative) of the magnetic brush, so that surface is cleaned to be used again for the image formation.

The untransferred toner taken in the magnetic brush charging device 2 has a normal charging polarity as a result of friction with the magnetic particles 23. The toner (negative) is discharged uniformly to the surface of the photosensitive member, and similarly to Embodiment 1, the photosensitive member surface carrying the remaining toner is uniformly charged and exposed to image light, and is then subjected to a developing operation at the developing station by a developing device 3, and simultaneously therewith, the residual toner is collected by the developing device and is reused.

The description will be made as to a device for detecting a physical quantity relating to the toner amount to predict the toner amount in the magnetic brush charging device used in this example.

The color image forming apparatus of this example is provided with a reflection density meter 7 for measuring a toner density on the photosensitive member to keep the color balance.

The reflection density meter 7 measures the toner density of the developed image in the non-sheet-passing area(non-image area) on the photosensitive member after the development and before the transfer, and in accordance with the measurement, the bias is adjusted to adjust the color balance.

In this example, the reflection density meter 7 is utilized. When the image is not formed, a constant potential difference is provided to the magnetic brush charging device 2, and at this time, a part of the toner in the charging device is discharged from the charging device onto the photosensitive member 1. The toner density of the discharged toner (a physical quantity relating to the amount of introduced toner) is measured, on the basis of which the toner amount in the magnetic brush charging device 2 is predicted.

Figure 6:
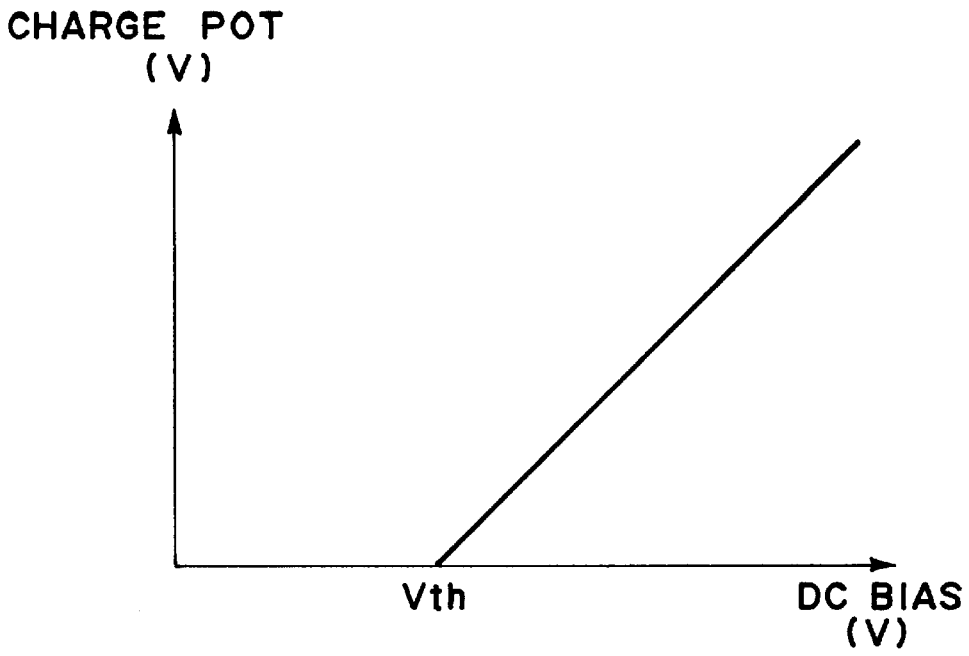
FIG. 6 is a graph showing a charging DC bias and a charged potential according to a second embodiment.

Actually, when the image is not formed, the photosensitive member is subjected to whole surface exposure by the laser beam L, and the developing bias and the transfer bias are rendered off to provide a uniform potential. The AC bias component of the charging bias is stopped, and a DC bias of −100V is applied, by which the potential difference between the surface potential of the photosensitive member and the potential(−100V) on the magnetic brush charging device is made constant. Here, when the charging bias having only the DC bias is applied to the magnetic brush charging device 2, a relation between the applied DC bias in the case of the charging type using the discharge and the charged potential of the photosensitive member(which is 0 before the charging), is as shown in FIG. 6. The photosensitive member 1 has a charge starting voltage Vth. So, if the DC bias is not more than Vth, the magnetic brush charging device 2 can be supplied with a constant potential difference with the photosensitive member 1 being not charged The charge starting voltage Vth changes with the thickness and the dielectric constant of the photosensitive layer.

By the constant potential difference between the photosensitive member and the magnetic brush charging device 2, a part of the toner in the magnetic brush charging device, is deposited onto the photosensitive member 1. By stopping the sleeve driving in the developing device, it reaches the reflection density meter 7 without being collected by the developing device 3.

Similarly to the normal operation wherein the reflection density meter 7 detects the toner to be developed for the density balance adjustment, it detects the toner on the drum discharged from the magnetic brush charging device 2, and the toner amount in the magnetic brush charging device 2 is calculated on the basis of the detected reflection density. Even if the amount of the toner discharged from the charging device is small, the toner amount in the charging device can be predicted by detecting the discharged toner amount, since there is a certain relation between the discharged toner amount and the toner amount remaining in the charging device after the discharge.

In accordance with the increase of the toner amount, the setting is changed to raise the DC bias of the charging bias among the process conditions so as to provide the predetermined charged potential even if the toner is introduced into the magnetic brush charging device. Or, the image forming operation is prohibited when the toner amount is higher than a predetermined level.

Heretofore, with increase of the number of the prints, the amount of introduced toner in the magnetic brush charging device 2 increases, and therefore, the charging property thereof is deteriorated with the result of so-called reverse charge fog caused by deposition of the toner charged to the polarity opposite from the normal polarity. According to this embodiment, the charged potential can be controlled for the image forming unit for each color, so that stabilized color images can be formed for long term.

According to this embodiment, there is provided an image forming apparatus wherein the untransferred toner is at least temporarily collected by the magnetic brush charging device, the predetermined cleaning bias is applied to the magnetic brush charging device so as to returns the toner from the charging device onto the image bearing member, and the toner density of the toner returned to the photosensitive member is measured, and on the basis of the measurement, the toner amount in the magnetic brush is predicted, and then, the setting of the image forming process condition of the image forming apparatus is changed, or the image forming operation is prohibited, by which the defective image due to the deterioration of the charging property as a result of the increase of the amount of introduced toner in the magnetic brush charging device, can be prevented beforehand.

In this example, a color image forming apparatus is used, but this is not limiting. The adjustment of the charging bias is not limiting either, and it shows an example of the process condition change.

Third embodiment

This embodiment is similar to the second embodiment, but uses an injection charging type. The toner density detection method will be described.

As described above, the applied DC bias is substantially the same as the charged potential in the injection charging type, and therefore, the introduced toner is incapable of being discharged by a constant potential difference.

Figure 7:
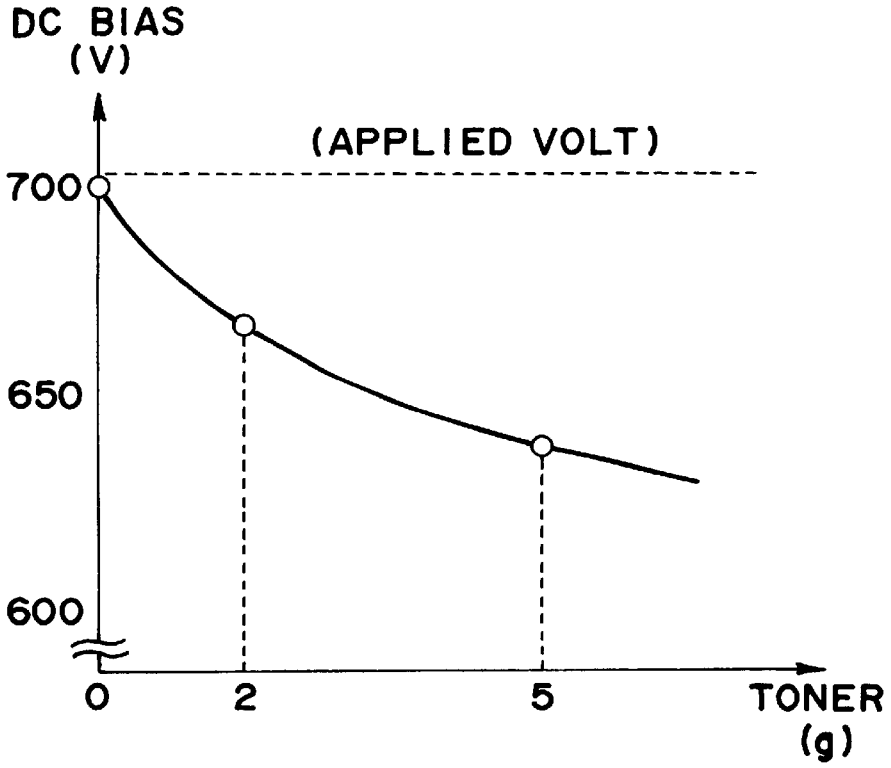
FIG. 7 is a graph showing a relation between an amount of introduced toner in the magnetic brush charging device and a charged potential in an injection charging type.

As shown in. FIG. 7, in accordance with introduction of the toner in the magnetic brush charging device, the charging property is deteriorated so that charged potential lower s. This produced a potential difference between the photosensitive member 1 and the magnetic brush charging device 2.

A relation is determined beforehand between the toner density of the toner discharged by the potential difference at this time and the amount of introduced toner in the charging device. Using the relation, the same advantageous effects as the second embodiment are provided.

As described above, according to this embodiment, there is provided an image forming apparatus using an injection charging type, wherein the toner amount in the magnetic brush is predicted, using a predetermined relation, by measuring the toner density on the photosensitive member, and on the basis of the measurement, the toner amount in the magnetic brush is predicted, and then, the setting of the image forming process condition of the image forming apparatus is changed, or the image forming operation is prohibited, by which the defective image due to the deterioration of the charging property as a result of the increase of the amount of introduced toner In the magnetic brush charging device, can be prevented beforehand.

Fourth Embodiment

This embodiment provides an image forming apparatus wherein the untransferred toner is at least temporarily collected by a magnetic brush charging device, wherein the toner amount in the magnetic brush is predicted on the basis of image data and a transfer efficiency, and in accordance with the predicted toner amount, the setting of the image forming process condition for the image forming apparatus is changed, or the image forming operation is prohibited.

In this example, the image forming apparatus is a copying machine or laser beam printer having a digital image processing function. The fundamental structure is similar to the first embodiment.

The amount of the toner on the photosensitive member is calculated on the basis of the amount of image data (video signal) to be projected onto the photosensitive member 1 as a laser beam, and the resultant value is multiplied by a transfer efficiency at the transfer portion, by which the untransferred toner amount in the magnetic brush charging device 2 is calculated.

Untransferred toner amount=development toner amount x (1-transfer efficiency).

The toner introduced into the charging device 2 has a particular relation with the untransferred toner amount.

In accordance with the amount of introduced toner in the magnetic brush charging device 2 thus calculated, the setting of the image forming process condition of the image forming apparatus, is changed, or the image forming operation is prohibited. In this example, in order to prevent reverse charge fog resulting from deterioration of the charging property, the setting of the DC bias of the developing bias is lowered.

Actually, the transfer efficiency of the image forming apparatus is stably 90–95%, and therefore, a constant transfer efficiency is used. Therefore, the transfer efficiency was not detected in this embodiment. In order to make the calculation more accurate, a sensor or the like may be provided to measure the transfer efficiency(density) downstream of the transfer portion with respect to a rotational direction of the photosensitive member.

Heretofore, with increase of the number of the prints, the amount of introduced toner in the magnetic brush charging device 2 increases, and therefore, the charging property thereof is deteriorated with the result of so-called reverse charge fog. According to this embodiment, the developing bias is lowered in accordance with the deterioration of the charging property so that reverse charge fog can be prevented.

According to this embodiment, there is provided an image forming apparatus wherein an untransferred toner is at least temporarily collected by a magnetic brush charging device, wherein the toner amount in the magnetic brush is calculated on the basis of the image data (and the transfer efficiency), and the setting of the image forming process condition of the image forming apparatus is changed in accordance with the toner amount, or the image forming operation is prohibited, by which the defective image due to the deterioration of the charging property as a result of the increase of the amount of introduced toner in the magnetic brush charging device can be prevented beforehand. Furthermore, the amount of introduced toner in the magnetic brush charging device can be measured without adding a particular means.

In the foregoing embodiments, the charging bias applied to the magnetic brush charging device is an oscillating voltage in the form of a DC bias(DC voltage) plus AC bias(AC voltage) superposed to each other to increase the charging property. This is intended to raise the charged potential at the polarity which is the same as the AC bias charging potential, and to converge the charging potential to the predetermined potential(DC bias level) by the alternating application, thus supplementing the deterioration of the charging property of the magnetic brush charging device.

The degree of raising of the charging potential of the AC bias is determined by the level of the voltage at the same polarity as the charging potential. In order to converge the charging potential to the predetermined potential, it is preferable that level at the opposite polarity side from that of the charging potential of the AC bias is the same as that at the same polarity side. Therefore, the charging property of the magnetic brush charging device is determined by the peak-to-peak voltage (Vpp) of the AC bias. When the AC bias is quite high in consideration of the case that large amount of the toner is introduced into the magnetic brush portion, the potential difference between the charged potential and the charging bias applied to the magnetic brush charging device is also large. Then, the potential difference may be enough to deposition the magnetic particles constituting the magnetic brush portion on the photosensitive member as the member to be charged. So, it is difficult to satisfy both.

In order to accomplish both of the improvement of the charging property and the decrease of the deposition of the magnetic particles to the photosensitive member, it is preferable that magnitude of the AC voltage applied to the charging sleeve is changed in accordance with the toner amount introduced to the charging device. Such an embodiment will be described.

Figure 8:
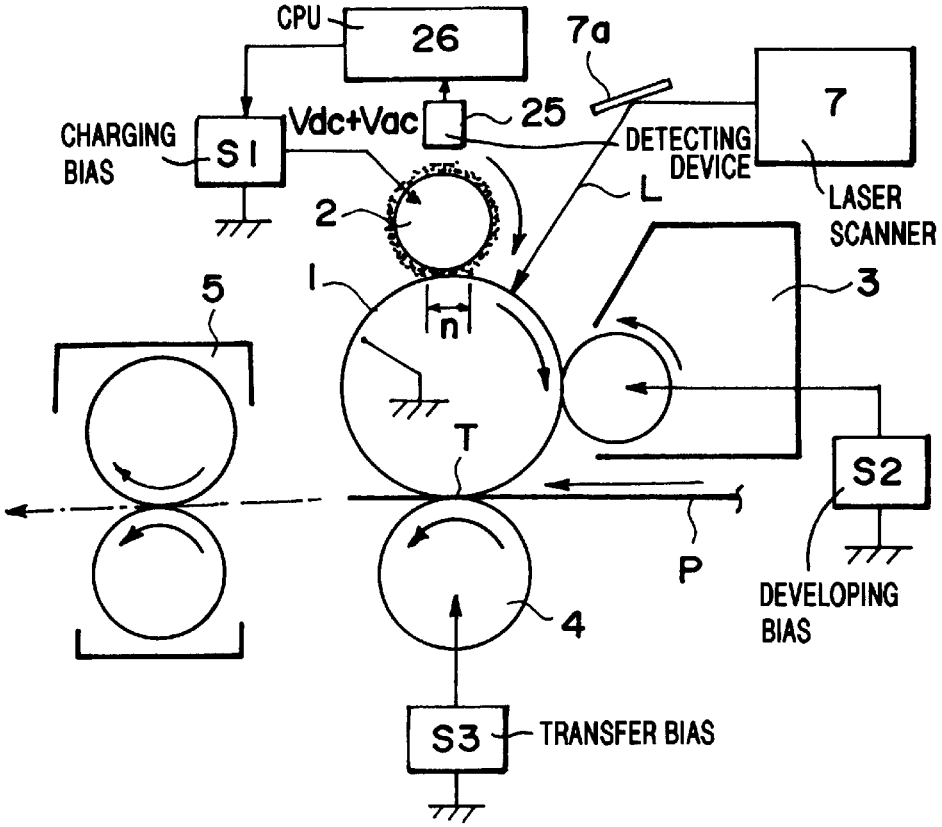
FIG. 8 is a schematic illustration of an image forming apparatus according to a fifth embodiment.
Figure 9:
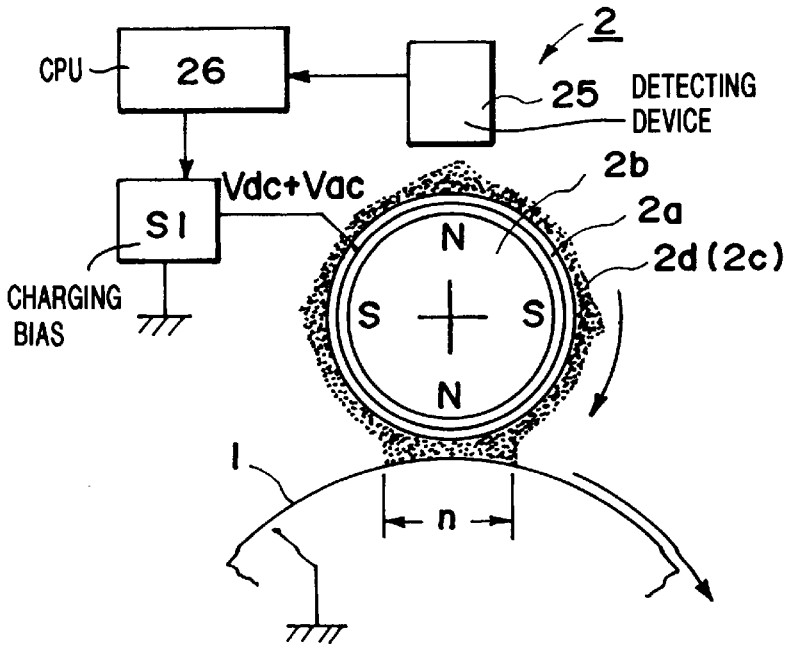
FIG. 9 is a schematic view of a magnetic brush charging device of a rotatable sleeve type.
Figure 10:
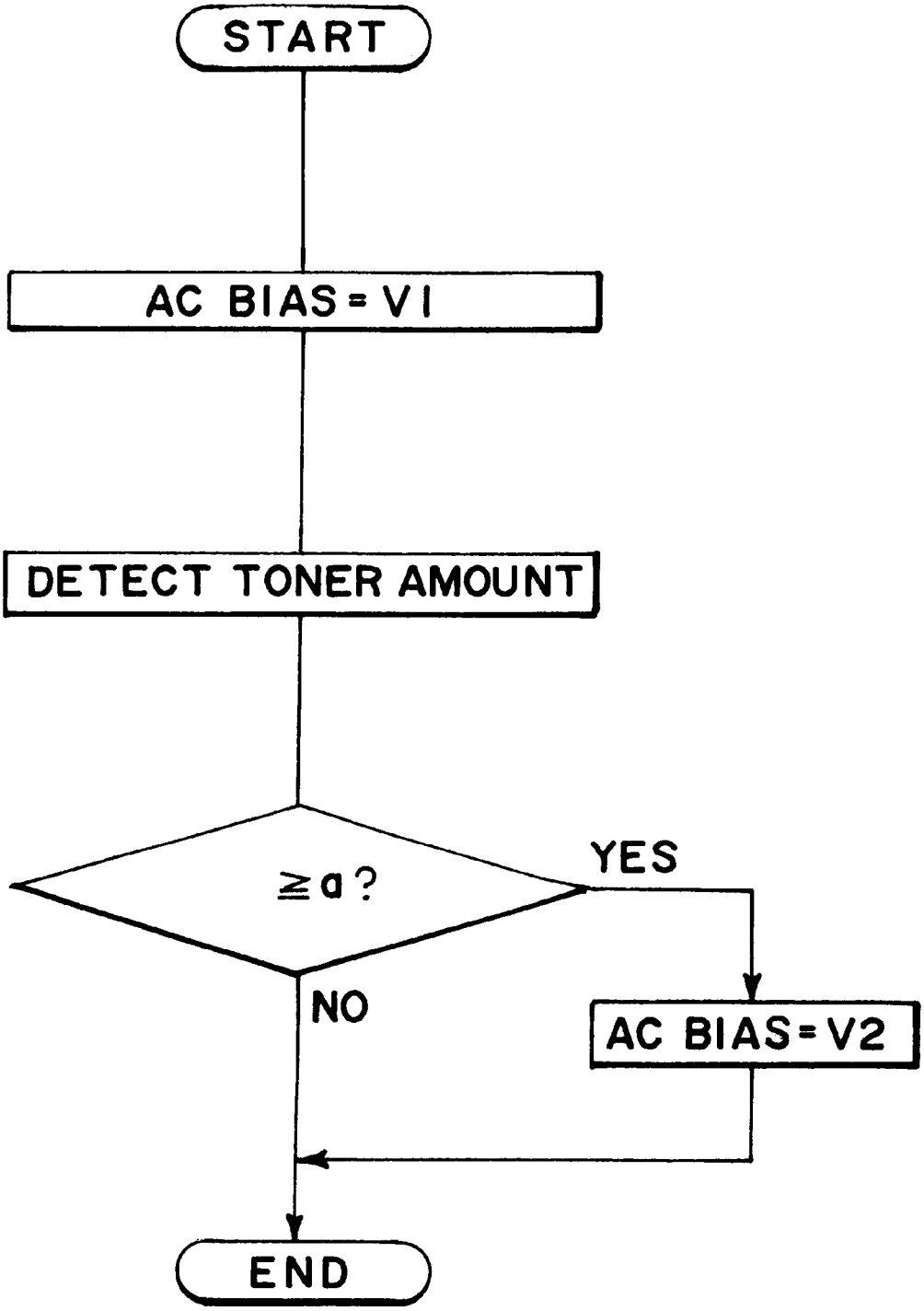
FIG. 10 is a flow chart for an AC bias control used in the fifth embodiment.

Fifth Embodiment (FIG. 8–FIG. 10)

Example of a Image Forming Apparatus

FIG. 8 is a schematic view of an example of an image forming apparatus according to Embodiment 1 of the present the invention. The image forming apparatus of this embodiment is a laser beam printer of cleaner-less type using a transfer type using a electrophotographic process and using a magnetic brush charging.

Designated by 1 is an electrophotographic photosensitive member of a rotatable drum type as an image bearing member. The photosensitive member 1 is rotated in the clockwise direction indicated by the arrow at a predetermined process speed(peripheral speed).

Designated by 2 is a magnetic brush charging device as a contact charging device contacted to the photosensitive member 1. It is in the form of a rotatable sleeve. The magnetic brush charging device 2 will be described hereinafter.

The magnetic brush charging device 2 is supplied with an oscillating voltage having a periodically changing voltage level (DC plus AC) from a charging bias applying voltage source S1 to uniformly charge the outer peripheral surface of the photosensitive member 1 to a predetermined polarity and potential. The DC bias component has a level equivalent to the desired charged potential, and is −700V (Vdc).

The charged surface of the photosensitive member 1 is exposed to scanning exposure L by a laser scanner 7, so that electrostatic latent image is formed on the peripheral surface of the rotatable photosensitive member 1 in accordance with the intended image information. The laser scanner 7 emits a laser beam modulated in intensity corresponding to time series digital pixel signal of intended image information. Designated by 7*a* is a deflection mirror to direct the output laser beam from the laser scanner 7 to the photosensitive member 1.

The electrostatic latent image on the surface of the photosensitive member 1 is developed (reverse development) into a toner image by a developing device 3 using insulative toner. Designated by S2 is a developing bias applying voltage source for applying a predetermined developing bias to the developing device 3.

On the other hand, a transfer material. P as a recording material is fed out to an unshown sheet feeding station and is fed into a nip(transfer portion)T formed between the photosensitive member 1 and a transfer roller 4 as a contact type transferring device having an intermediate resistance contacted thereto a predetermined urging force. The transfer roller 4 is supplied with a transfer bias voltage of the polarity opposite from that of the toner from the transfer bias application voltage source S3.

The transfer material P introduced to the transfer portion T is passed through the nip, and the toner image is continuously transferred from the surface of the photosensitive member 1 onto the transfer material P by the electrostatic force and the pressure.

The transfer material P now having the toner image, is separated from the surface of the photosensitive member 1, and is fed to a heat fixing type fixing device 5, where the toner image is fixed on the transfer material P. Finally, it is discharged as a print.

No cleaning device exclusively for the removal of the untransferred toner from the surface of the photosensitive member after the toner image transfer, is provided. The surface of the photosensitive member after the toner image transfer to the transfer material P, reaches the contact portion n where it is contacted to the magnetic brush charging device 2, while carrying the untransferred toner. By the magnetic brush charging device 2, the untransferred toner is at least temporarily taken up by sliding force and the charging bias(negative) of the magnetic brush, so that surface is cleaned (simultaneous charging and cleaning) to be used again for the image formation.

The untransferred toner introduced into the magnetic brush charging device 2, is charged by the friction with the magnetic particles 23, and is discharged uniformly onto the surface of the photosensitive member, and is then collected (simultaneous development and cleaning) by the developing device 3 at a developing station to be reused for the development.

(2) Magnetic Brush Charging Device 2

FIG. 9 is a view of a magnetic brush charging device 2. It comprises a magnet roller 2*b* as magnetic field generating means, a non-magnetic electrode sleeve 2*a* of aluminum or the like enclosing the magnet roller coaxially and rotatably, a magnetic brush layer 2*d* of magnetic particles 2*c* magnetically attracted on the outer peripheral surface of the electrode sleeve by the magnetic force of the magnet roller 2*b* therein, and a detecting device 25, deposited adjacent to the magnetic brush layer, for detecting a toner amount in the magnetic brush layer.

The magnetic particles 2*c* constituting the magnetic brush portion 2*d* may be of magnetic metal particles such as ferrite or magnetite particles, or these particles bound by binder region. The resistance value is preferably $1\times10^5$–$10^8$ Ωcm. The particle size thereof is preferably 10–50 μm. It is preferable to mix a plurality of magnetic particles, since the charging property may be improved.

The resistance value of the magnetic particles is measured in the following manner: 2 g of the magnetic particles is placed in a metal cell having a bottom surface area of 228 $mm^2$ to which a voltage is applicable, and the current is measured when a voltage of 100V is applied. This is used in embodiments 1–4, too.

The average particle size of the magnetic particles, is indicated by a maximum angular distance in the horizontal direction. More than 300 particles are randomly extracted using an optical microscope, and diameters thereof are measured, and the measurements are averaged.

For the magnetic property measurement of the magnetic particle, a DC magnetization B–H property automatic recording device BH-50, available from Riken Denshi Kabushiki Kaisha, is usable. The particles are filled into a cylindrical container having a diameter(inner diameter)6.5 mm and height 10 mm, at approx. 2 g, and motion of the particles in the container is prevented. The saturation magnetization is measured from the B–H curve.

The magnetic brush charging device 2 is disposed substantially in parallel with the photosensitive member 1 with a space of 0.5 mm between the surface of the electrode sleeve 2*a* and the surface of the photosensitive member 1. The space is maintained by a spacer member (unshown) contacted to the photosensitive member at the longitudinal ends. The magnetic brush layer 2*d* is formed with a predetermined width (charge portion n) relative to the surface and is contacted to the surface of the photosensitive member 1.

At the charge portion n, the direction of movement of the surface of the electrode sleeve 2*a* is opposite from that of the photosensitive member 1, and is rotated in the clockwise direction indicated by the arrow in the Figure. They may be rotated at the same peripheral speeds, and the magnetic brush layer 2*d* is rotated in the same direction as the sleeve, so that surface of the photosensitive members 1 rubbed by the magnetic brush layer 2*d*.

During the charging operation, the electrode sleeve 2*a* of the magnetic brush charging device 2 is supplied from the charging bias applying voltage source S1 with the predetermined charging bias Vdc+Vac (oscillating voltage), so that photosensitive member surface is charged substantially to the same potential as the DC bias component Vdc of the applied charging bias by the charge portion n through the magnetic particles 2*c* of the magnetic brush layer 2*d*.

(3) AC Bias Control

As has been described hereinbefore, the untransferred toner on the surface on the photosensitive member after the toner image transfer, reaches, by the rotation of the photosensitive member 1, the portion of the magnetic brush charging device 2, and is at least temporarily collected in the magnetic brush layer 2*d* (simultaneous charging and cleaning). The charging property of the magnetic brush charging device 2 is deteriorated due to the introduction of the toner which has the high resistance into the magnetic brush layer 2*d*.

In this embodiment, there is provided a detecting device 25 for detecting the toner amount in the magnetic brush charging device 2 (magnetic brush layer 2*d*). The detected information is fed to the control circuit portion(CPU) 26. The control circuit portion 26 controls the charging bias applying voltage source S1 in accordance with the detected toner amount to change AC bias component Vac of the charging bias Vdc+Vac between a first bias value V1 (reference) and a second bias value V2 having a peak-to-peak voltage larger than that of the first bias value V1. By doing so, the toner amount in the magnetic brush charging device is changed to provide a stabilized charging property and to prevent the deposition of the magnetic particles to the photosensitive member.

The toner amount detecting device 25 may be any if it can detect the toner amount in the magnetic brush layer 2*d*. For example, a photo-sensor used in a two-component developer type developing device is available, which detects the reflected light quantity.

As has been described hereinbefore, if the AC bias component(peak-to-peak) of the charging bias Vdc+Vac applied to the magnetic brush charging device 2, is made large in consideration of the possibility that charging property thereof will be deteriorated by the introduction of the untransferred toner into the magnetic brush layer, a large potential difference occurs in magnetic particles at the initial stage of use of the magnetic brush charging device in which the amount of the untransferred toner is small. This may make the magnetic particle deposition on the photosensitive member 1.

In this example, as shown in a flow chart of FIG. 10, when the amount of introduced toner in the magnetic brush charging device(magnetic brush layer) detected by the toner amount detecting device 25, is smaller than a predetermined level a, the first AC bias V1 having a peak-to-peak voltage which is smaller than a reference voltage, is applied to the charging bias. When the toner amount is larger than the predetermined level a, the second AC bias V2 having a peak-to-peak voltage which is larger than the reference voltage is applied to the charging bias.

By this, when the toner amount in the magnetic brush charging device is small, the AC bias is made smaller to prevent the deposition of the magnetic particles to the photosensitive member, and when the toner amount is large, the AC bias is made larger to improve the charging property.

When the toner amount is large, the magnetic particle deposition does not occur, since even if the AC bias is made larger, the toner is deposited onto the photosensitive member since the toner has a higher resistance value than the magnetic particle.

In this embodiment, the reference, namely, the first AC bias V1=500 Vpp, and the second AC bias V2=100 Vpp. By these levels, the stabilized charging property and the magnetic particle deposition prevention are both accomplished even when the toner amount in the magnetic brush charging device variations.

Figure 11:
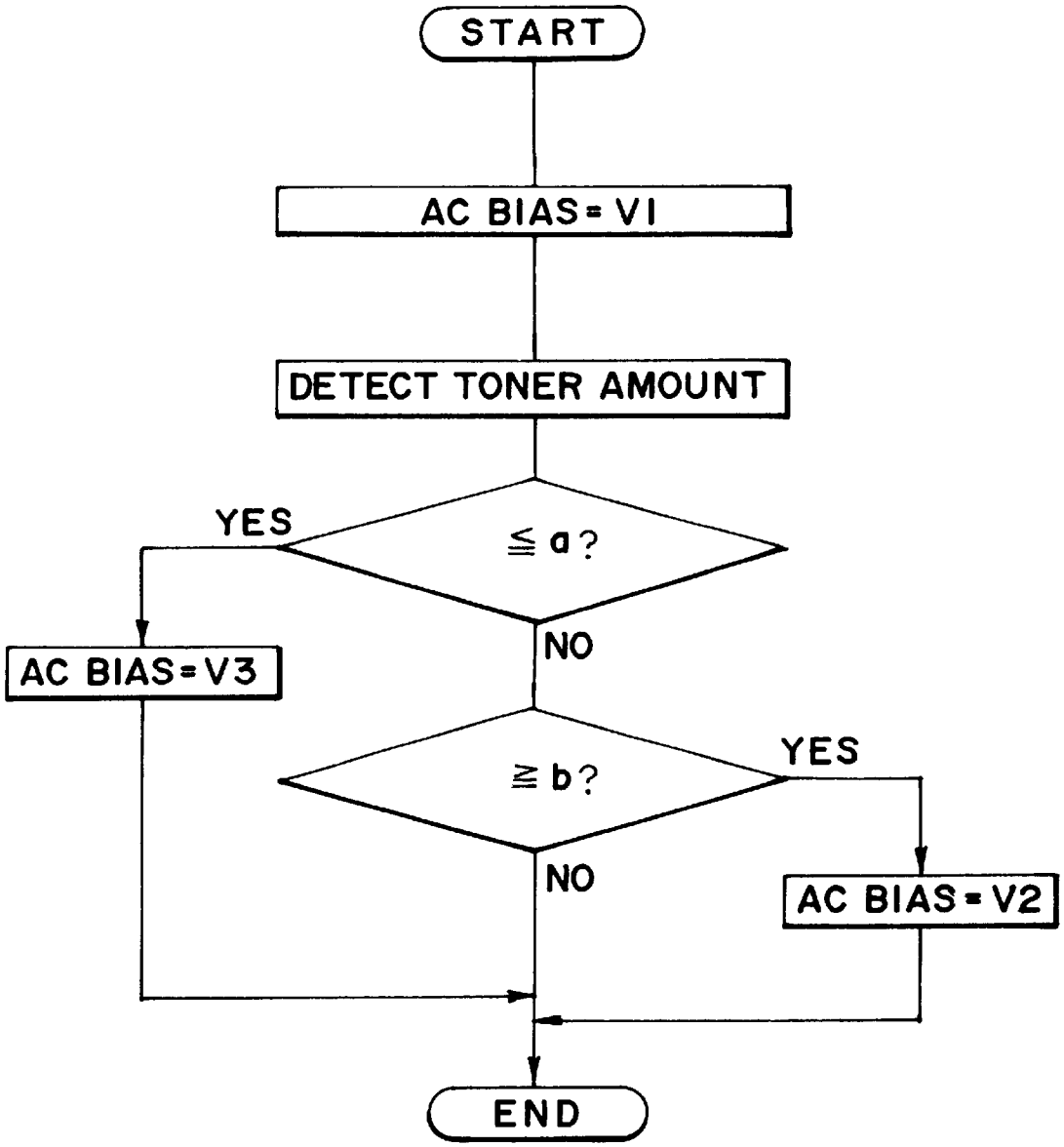
FIG. 11 is a flow chart for an AC bias control used in the fifth embodiment.

Sixth Embodiment (FIG. 11)

In this embodiment, the level of the AC bias component of the charging bias applied to the magnetic brush charging device 2 in accordance with the toner amount in the magnetic brush charging device detected by the toner amount detecting device 25, is controlled among three levels, namely, a first bias value V1 (reference), a second bias value V2 having a larger peak-to-peak voltage larger than that of the first bias value V1, and a third bias value V3 having a smaller peak-to-peak voltage larger than that. The apparatus of this embodiment is the same as that of the fifth embodiment in the other respects.

As shown in a flow chart of FIG. 11, control flow of FIG. 10 in fifth embodiment is modified to apply the AC bias V3 having a peak-to-peak voltage smaller than $V_2$. By this, the AC bias is made smaller than the reference value, the deposition of the magnetic particles can be reduced further, when the amount of introduced toner is very small, such as immediately after the cleaning bias is applied to returns the introduced toner to the photosensitive member.

Two discrimination levels a, b are provided for the toner amount in this example, with the reference AC bias V1=500 VPP, and a larger AC bias V2=1000 Vpp, and a smaller AC bias V3=200 Vpp. By these, the amount of deposited magnetic particles can be decrease decreased.

Figure 12:
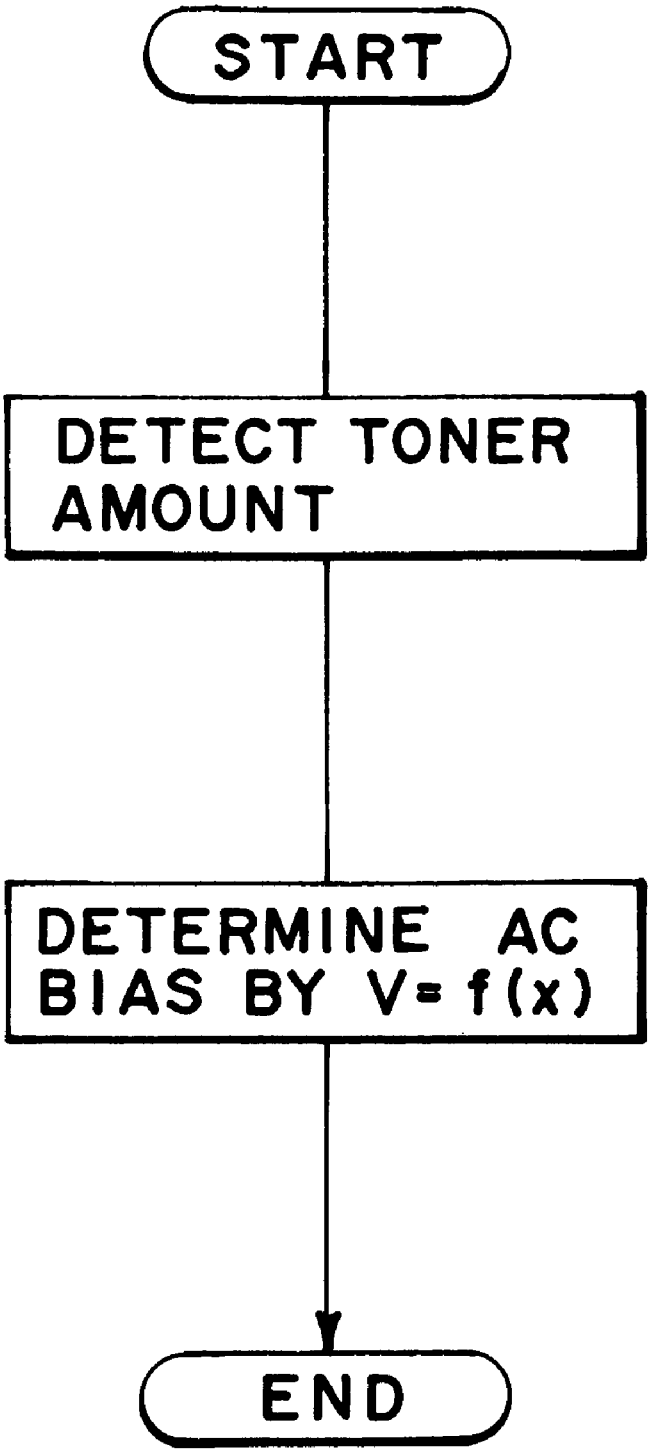
FIG. 12 is a flow chart for an AC bias control used in the seventh embodiment.
Figure 13:
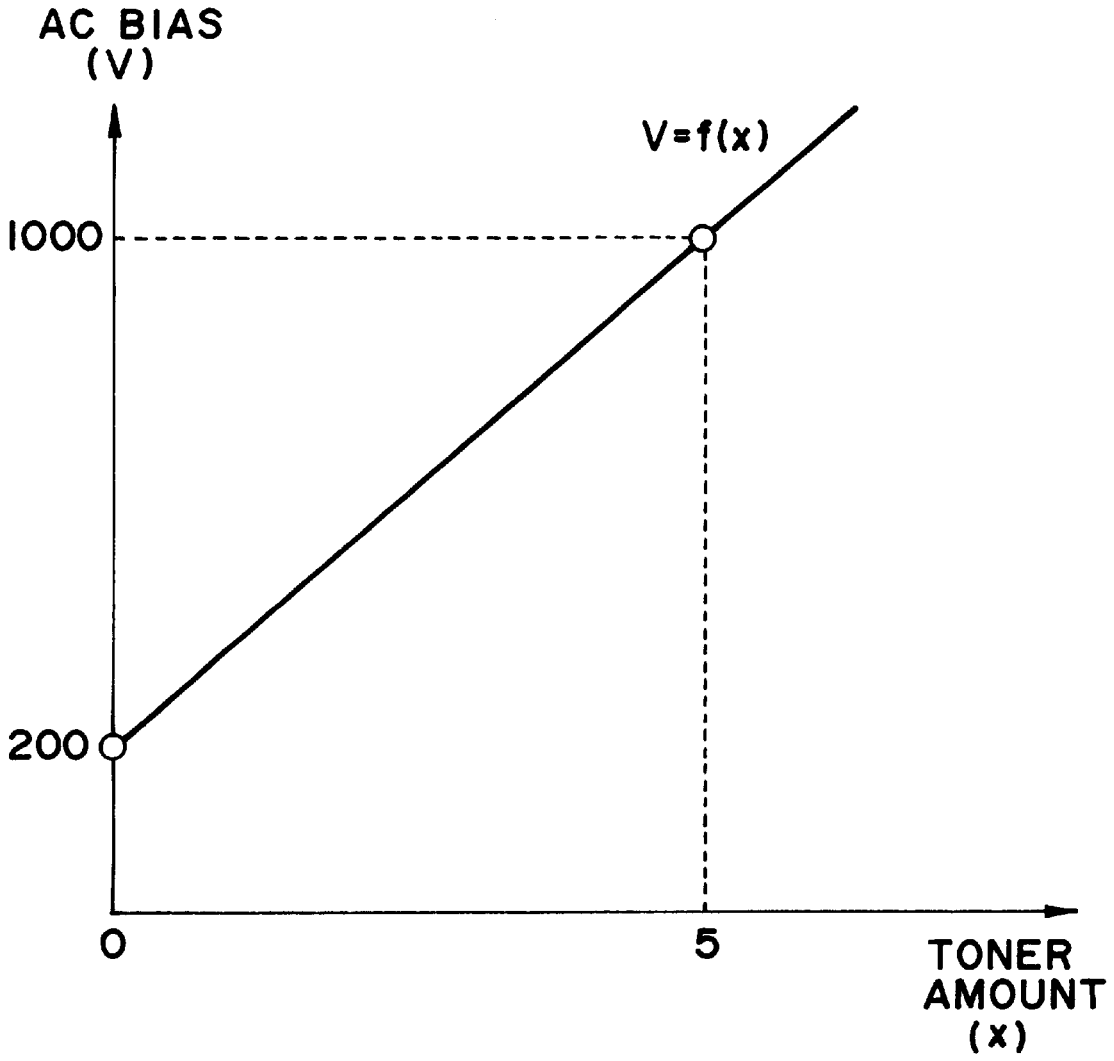
FIG. 13 is a graph of an example of a relation between a toner amount in a magnetic brush charging device and an AC bias in a seventh embodiment.

Seventh Embodiment (FIGS. 12 and 13)

In this embodiment, the AC bias component of the charging bias applied to the magnetic brush charging device 2 in accordance with the toner amount in the magnetic brush charging device detected by the toner amount detecting device 25, is continuously changed. The apparatus of this embodiment is the same as that of the fifth embodiment in the other respects.

In the fifth and sixth embodiments, the AC bias is stepwisely changed in accordance with the amount of introduced toner. In the present embodiment, the AC bias is continuously change d in accordance with the toner amount in the magnetic brush charging device, as shown the flow chart of FIG. 12. By this, the AC bias can correspond precisely to the toner amount in the magnetic brush charging device, so that charging property of the magnetic brush charging device is stabilized, and therefore, good images can be provided for a long term.

In this embodiment, the relation V=f (x) between the toner amount x in the magnetic brush charging device and the AC bias V is determined as shown in FIG. 13; more particularly, the AC bias V=200 Vpp at the toner amount x=0 g, the AC bias V=1000 Vpp at the toner amount x=5 g, and these two plots are connected by a line to provide a relation of V=f (x)=160 x+200. Using this relation, the AC bias V is controlled in accordance with the toner amount x detected by the toner amount detecting device 25. It was confirmed that good images were provided for a long term.

The relation may be determined by a non-linear line. For example, the relation between the toner amount in the magnetic brush charging device and the charged potential is determined beforehand on the basis of measurements, and the relational expression may be determined on such a relation. By doing so, further stabilization of the charging property is accomplished.

As described hereinbefore, in the image forming apparatus wherein the untransferred toner is at least temporarily collected by the magnetic brush charging device(cleanerless), the charging property of the magnetic brush charging device may be deteriorated by introduction of the high resistance untransferred toner into the magnetic brush portion of the magnetic brush charger.

This problem arises also in an image forming apparatus having the cleaning device for the exclusive use, when the image formations are repeated. This is because small amount of the toner which has passed through the cleaning device, reaches the magnetic brush portion of the magnetic brush charger by the rotation of the photosensitive member, and is accumulated there.

In view of this, it is preferable that when the image forming operation is not carried out, the toner introduced and accumulated in the magnetic brush portion is discharged to limit the accumulation amount below an allowable level, thus maintaining the charging property. This may be accomplished by changing the bias setting or the operation state of the magnetic brush charger(magnetic brush cleaning mode).

By doing so, the potential difference between the charged potential of the photosensitive member and the bias applied to the magnetic brush portion, is changed, and the toner in the magnetic brush portion is moved to the photosensitive member using the potential difference. The electroconductive magnetic particles constituting the magnetic brush portion of the magnetic brush charger, preferably have the resistance value of $1\times10^5$–$10^8$ Ωcm from the standpoint of assuring the charging property and of preventing leakage when the photosensitive member as the member to be charged has a pin hole. On the other hand, the toner has a resistance value of not less than $1\times10^{15}$ Ωcm (high resistance). Therefore, the charge retentivity of the toner is higher than the magnetic particle. When the potential difference is produced, the toner is selectively transferred onto the photosensitive member surface. The toner thus discharged to the photosensitive member is collected by the developing device.

When the toner discharge cleaning for the magnetic brush charger is carried out at predetermined intervals, as has been described hereinbefore, the magnetic particles as well as the toner may be transferred to the photosensitive member when the toner amount in the magnetic brush portion is small.

If an amount of such magnetic particle transfer is too large, the amount of the magnetic particles in the magnetic brush portion becomes insufficient with the result of deterioration of the charging property, and the developing device may be adversely affected.

In the following embodiment, both of the maintenance of the charging property by discharging the toner to the photosensitive member and the reduction of the deposition of the magnetic particles to the photosensitive member, are accomplished.

Eighth Embodiment

In this embodiment, it is decided in accordance with the toner amount introduced into the magnetic brush charger whether a cleaning mode operation for discharging the toner to the photosensitive member, is carried out or not.

The image forming apparatus used in this embodiment, is the same as that of fifth embodiment (FIG. 8), and the fundamental structure of the magnetic brush charging device is the same as the fifth embodiment (FIG. 9). Therefore, the detailed description thereof is omitted for simplicity.

The magnetic particles 2*c* constituting the magnetic brush layer 2*d* may be of ferrite, magnetite or another magnetic metal particles, or may be such particles bound by binder resin. The average particle size thereof is preferably 10–100 μm, and the saturation magnetization at 1000 Gauss is preferably 20–300 emu/cm$^3$, and the resistance is preferably $10^5$–$10^8$ Ωcm. In this embodiment, ferrite particles having the average particle size of 30 μm, the volume resistivity of $6\times10^7$ Ωcm the saturation magnetization at 1000 Gauss of 280 emu/cm$^3$, and the specific gravity of 5.2 g/cm$^3$, were used.

The average particle size , the resistance and the magnetic property of the magnetic particles is measured in the same manner as in the fifth embodiment.

In this embodiment, there is provided a device 25 for detecting the toner amount introduced into the magnetic brush portion 2*d*, as shown in FIG. 9. In accordance with a detected toner amount by the detecting device 25, the cleaning mode is executed or not.

The toner amount detecting device 25 may be any if it can detect the toner amount in the magnetic brush portion 2*d*. For example, a photo-sensor used in a two component developing device is usable which detects the reflected light quantity; or a resistance change of the magnetic brush portion is predicted on the basis of detection of the charging current through the charger. The toner amount detecting means or method does not limit the present invention.

The output of the toner amount detecting device 25 is fed to a control circuit. The control circuit 26 controls the charging bias applying voltage source S1 in accordance with the input detected information to switch the enablement of the cleaning mode operation.

Figure 14:
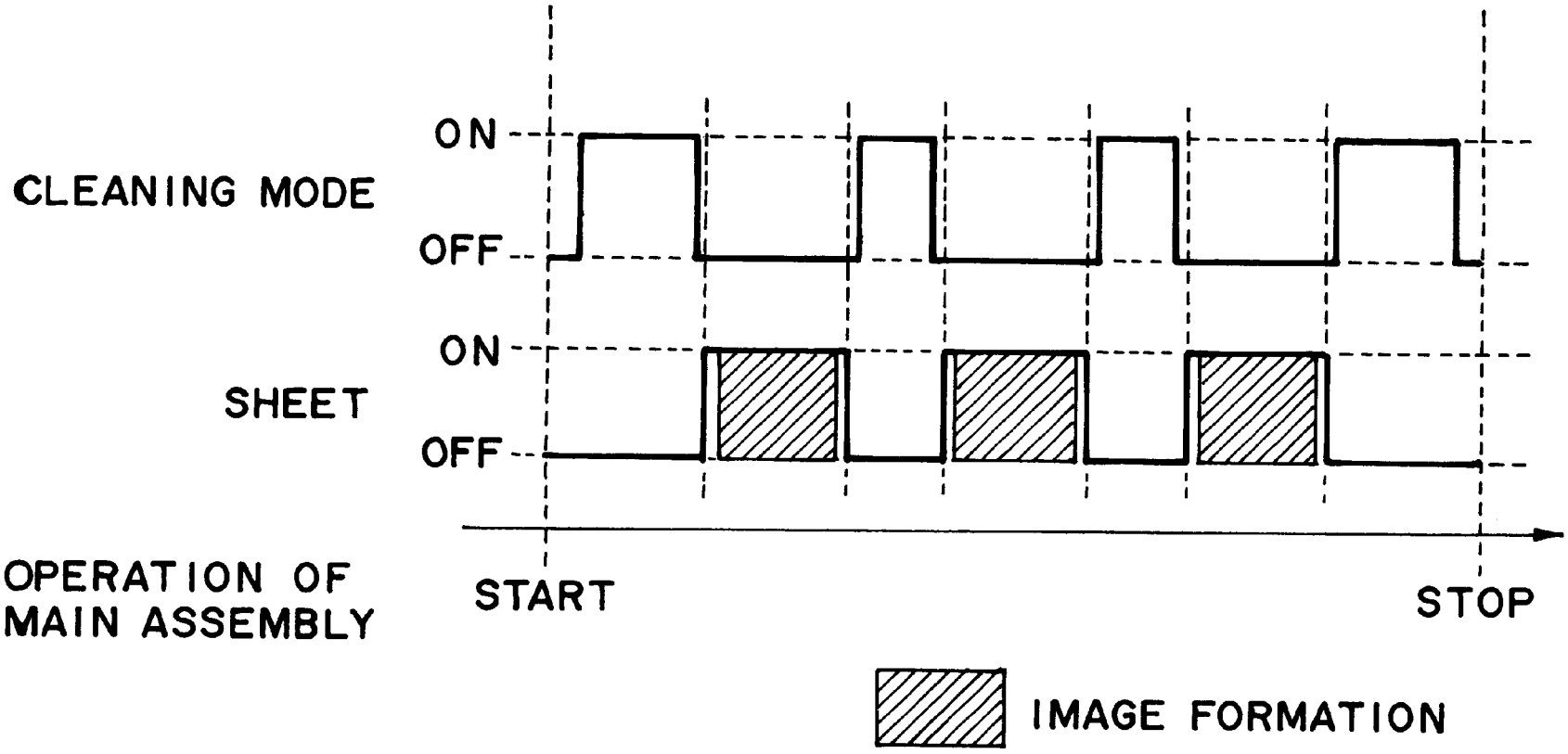
FIG. 14 is a timing chart in a cleaning mode.

In this embodiment, the toner discharge cleaning mode for the magnetic brush portion 2*d* is carried out fundamentally as shown in a timing chart of FIG. 14, not when the charging is carried out for the image formation for the hatched portion. More particularly, it is carried out between charging operation for a certain image formation and charging operation for the next image formation(between recording sheets), before the charging for the initial image formation or after the charging for the final image formation.

The discharge of the toner to the photosensitive member from the magnetic brush portion 2*d* is effected by the potential difference between the DC bias component applied thereto and the charged potential of the photosensitive member 1, when the AC bias component of the charging bias applied to the magnetic brush charging device 2 is rendered off. In this example, when only the DC bias component of −700V is applied, the charged potential on the photosensitive member 1 was −400V.

Figure 15:
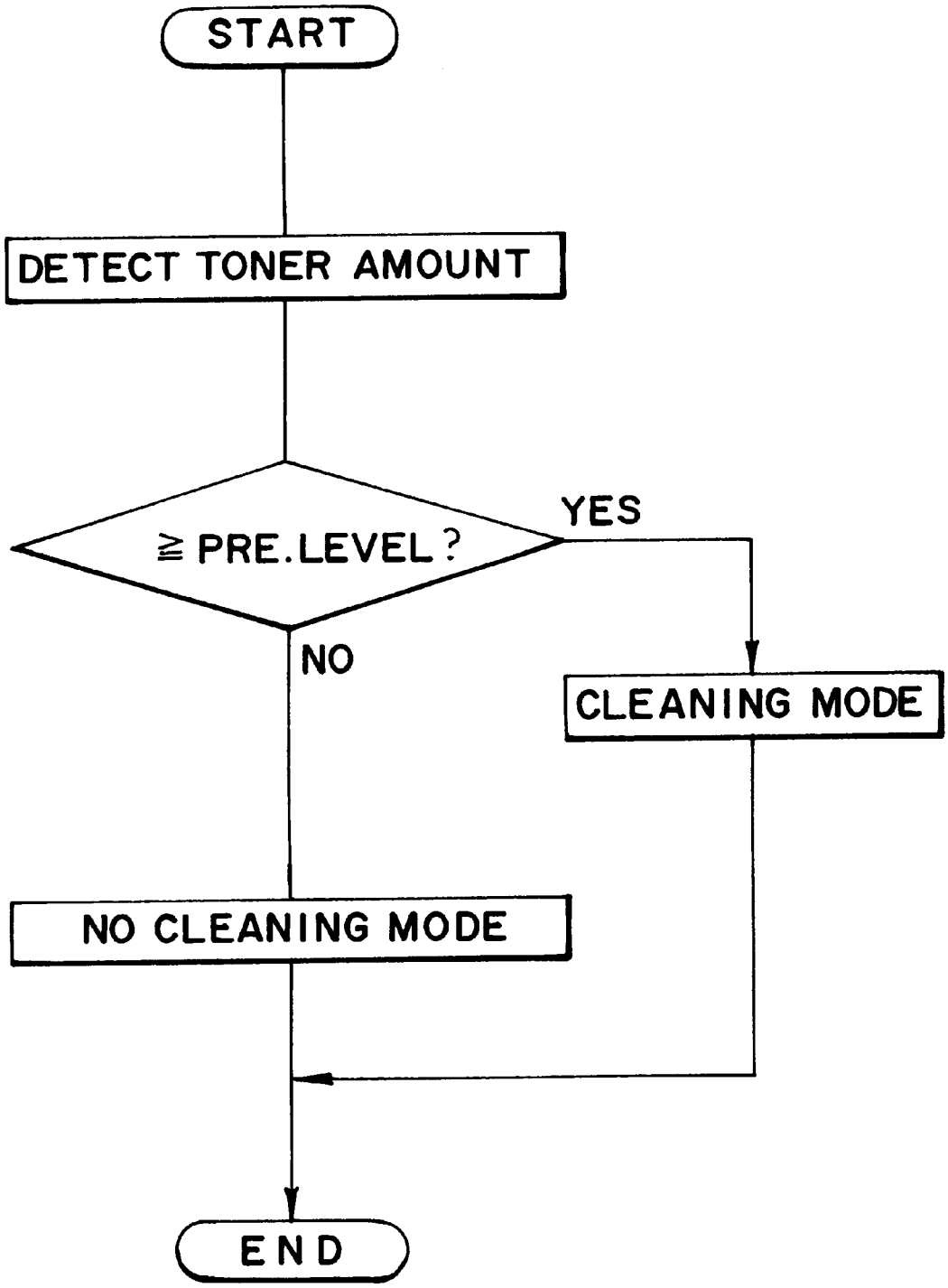
FIG. 15 is a flow chart for determining setting in a cleaning mode.

As shown in a flow chart of FIG. 15, when the toner amount in the magnetic brush portion 2*d* detected by the toner amount detecting device 25 is not less than a predetermined regulation value, the control circuit 26 controls the voltage source S1 to execute the cleaning mode to positively discharge the toner from the magnetic brush portion 2*d*. If, on the other hand, the detected toner amount is less than the predetermined regulation value, the control circuit 26 controls the voltage source S1 not to execute (to skip) the cleaning mode.

By doing so, when the toner amount in the magnetic brush portion 2*d* is large, the cleaning mode operation is carried out to maintain the charging property, and when the toner amount is small, the cleaning mode is not carried out to prevent the deposition of the magnetic particles onto the photosensitive member.

In this example, the cleaning mode is carried out when the toner amount is not less than 0.03 wt %. It was confirmed that stabilized charging property and carrier deposition prevention were both accomplished even when the toner amount in the magnetic brush portion 2*d* varied.

Figure 16:
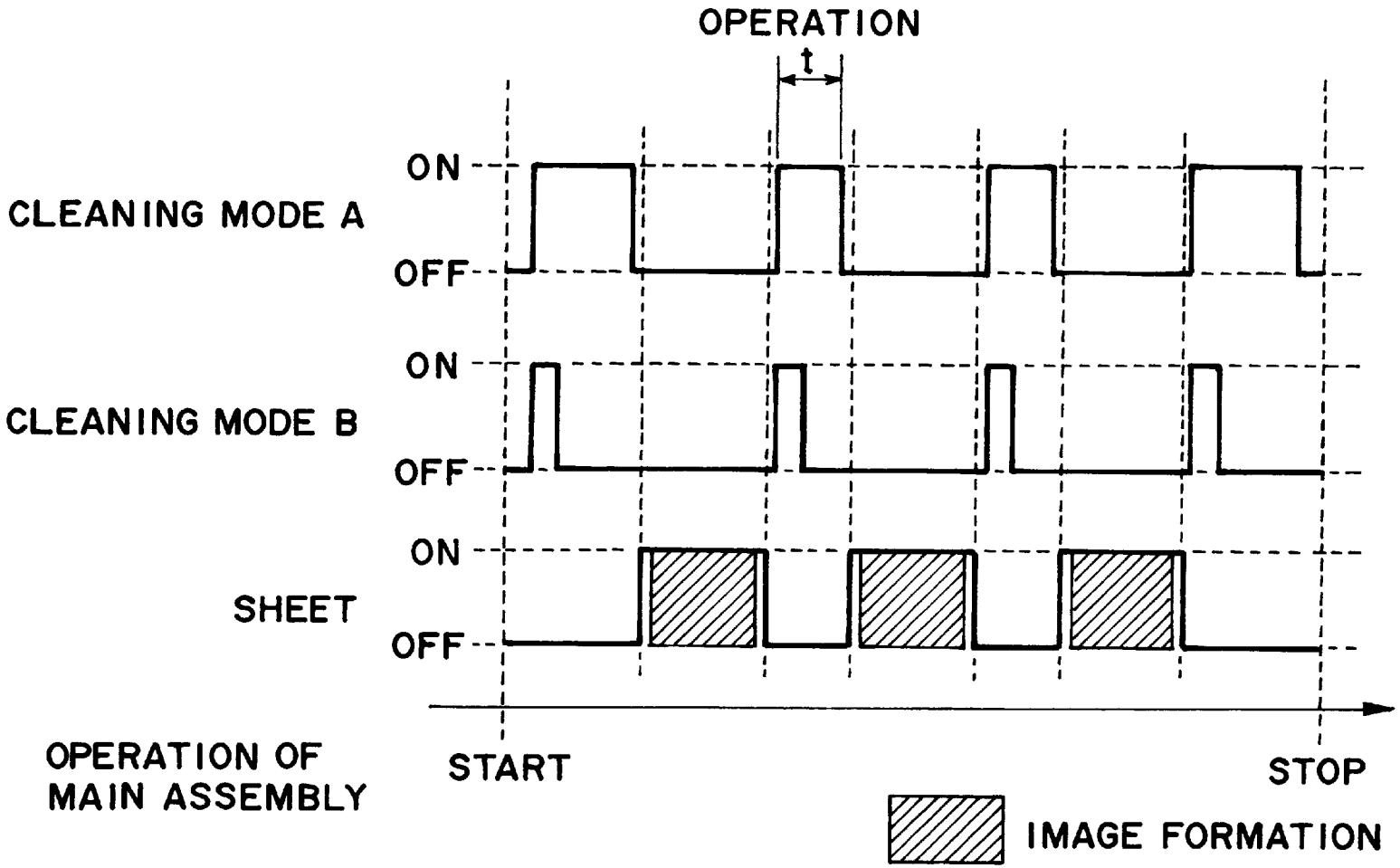
FIG. 16 is a timing chart of a cleaning mode used in an apparatus according to a ninth embodiment.

Ninth Embodiment (FIG. 16)

In this embodiment, there is provided a device 25 for detecting the toner amount introduced into the magnetic brush portion 2*d*, and in accordance with the detected toner amount by the detecting device 25, the operation period of the cleaning mode for the magnetic brush portion 2*d* is switched.

As shown in a timing chart of FIG. 16, the operation period of the cleaning mode when the image forming operation is not carried out, is changed in accordance with the toner amount in the magnetic brush portion 2*d* detected by the detecting device 25, and when the toner amount in the magnetic brush portion 2*d* is not less than a predetermined regulation value, a cleaning mode A having long operation period is carried out to positively discharge the toner from the magnetic brush portion 2*d* to maintain the deterioration of the charging property. On the other hand, when the toner amount in the magnetic brush portion 2*d* is less than the predetermined regulation value, a cleaning mode B having a short operation period is carried out to prevent the deposition of the magnetic particles from the magnetic brush portion 2*d* to the drum.

In this embodiment, the cleaning mode B has a shorter operation period. It is an alternative to continuously change the period in accordance with the toner amount in the magnetic brush portion 2*d*. When the magnetic brush portion 2*d* hardly contains the toner, operation period may be set to zero (t=0), thus killing the cleaning mode.

By controlling the operation period of the cleaning mode in accordance with the toner amount in the magnetic brush portion 2*d* in this manner, the stabilized charging property can be maintained while preventing the deposition of the magnetic particles.

In an example of this embodiment, when the toner amount is not more than 0.01 wt %, the operation period t=0, and when the toner amount is not loss than 0.05 wt %, the operation period is the maximum, and the operation period is changed linearly therebetween in accordance with the toner amount detected. It was confirmed that by this, the stabilized charging property was provided while preventing the magnetic particle deposit.

Figure 17:
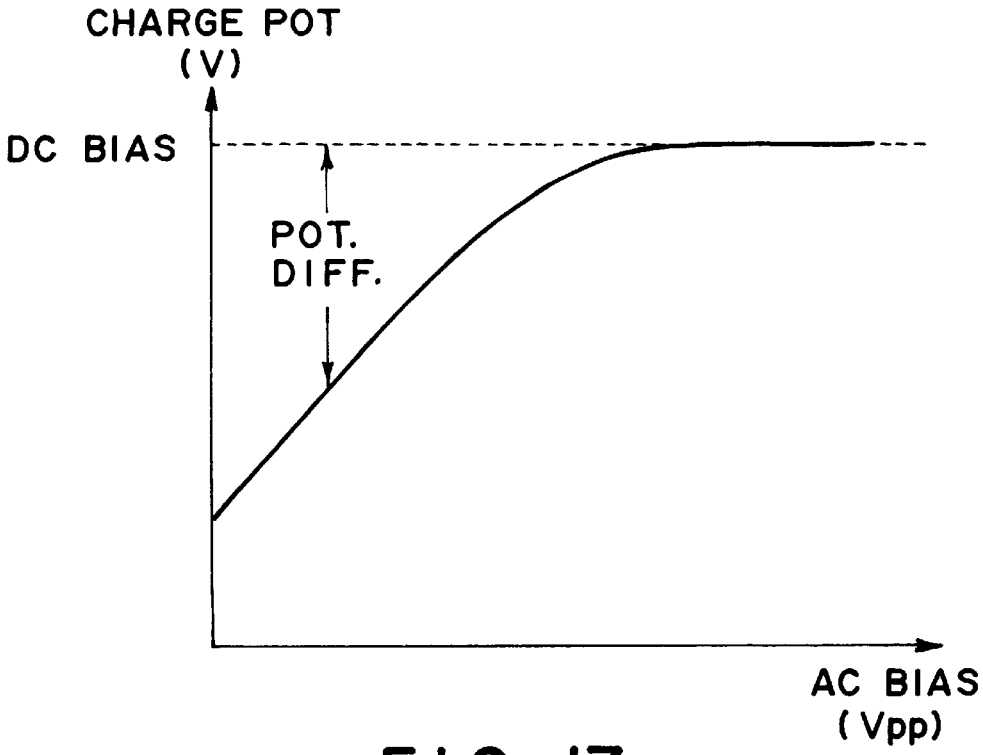
FIG. 17 shows a relation between a charging AC bias and a charged potential of the photosensitive member.
Figure 18:
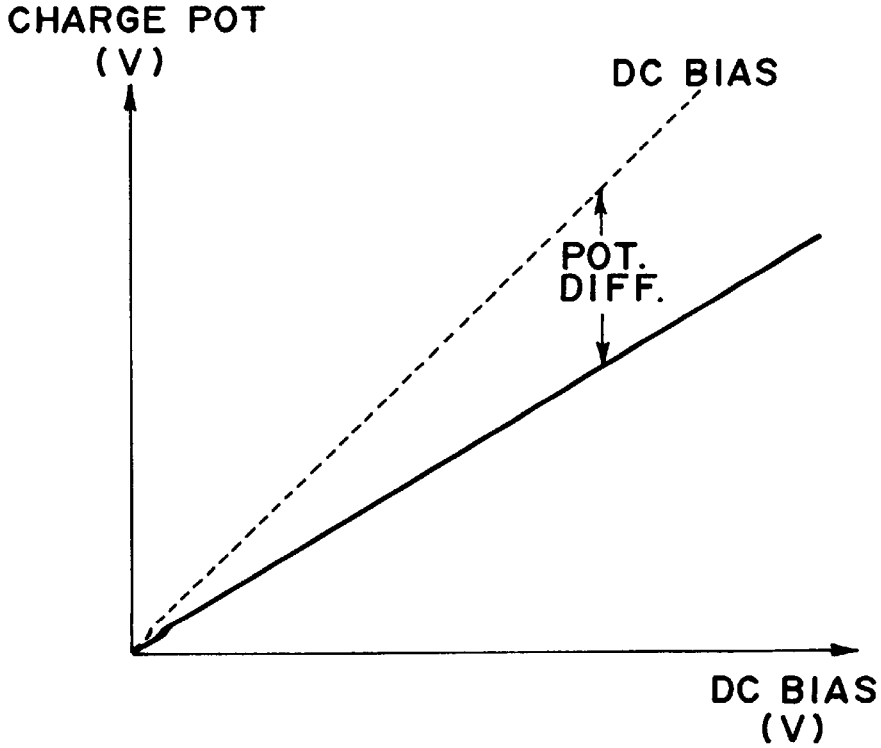
FIG. 18 shows a relation between a charging AC bias and a charged potential of the photosensitive member.

Eighth Embodiment (FIGS. 17, 18)

In this embodiment, there is provided a device 25 for detecting the toner amount introduced into the magnetic brush portion 2*d*, and in accordance with the toner amount detected by the detecting device 25, a cleaning intensity of the cleaning mode for the magnetic brush portion is switched by changing the potential difference for discharging the toner from the magnetic brush portion during the cleaning mode.

There are some methods to change the potential difference for discharging the toner from the magnetic brush portion 2*d*. As shown in FIG. 17, for example, the peak-to-peak voltage of the AC bias component of the charging bias is gradually decreased, or the AC bias component is rendered off, and the DC bias component is changed, as shown in FIG. 18. The change method for the cleaning intensity is not limiting to the present invention.

The operation period in the cleaning mode in this example is similar to that shown in the timing chart of FIG. 14 in the eighth embodiment. It is an alternative to change the operation period in accordance with the toner amount in the magnetic brush portion 2*d*, as in the ninth embodiment.

By changing the cleaning intensity in accordance with the toner amount in the magnetic brush portion 2*d* in this manner, high intensity cleaning mode operation is carried out when the toner amount in the magnetic brush portion is not less than a regulation value to maintain the charging property, and when the toner amount is less than the regulation value, the low intensity cleaning mode operation is carried out to reduce the magnetic particle deposit.

In this example, when the detected toner amount is not more than 0.01 wt %, the potential difference relative to the photosensitive member 1 is 50V, and when the toner amount is 0.05 wt %, the potential difference is changed to 300V. By this, the improvement of the charging property and the prevention of the magnetic particle deposition could both be accomplished.

In embodiments 5–10, the method of detecting a physical quantity relating to the toner amount in the charging device as shown in embodiments 1–4 may be used.

It is desirable in any of the embodiments that image bearing member is provided with a surface charge injection layer(injection charging type) similarly to embodiment 1.

1. The waveform of the alternating voltage in the AC bias be in the form of sunisoidal wave, rectangular wave, triangular wave or the like. The rectangular wave may be produced by periodically rendering ON and off a DC voltage. The AC bias or the alternating voltage may be a voltage whose voltage periodically changes.

2. The magnetic brush charger 3 is not limited for the use with the rotatable sleeve type as described above, but is applicable to a device wherein the magnet roller 3*b* rotates, to a device wherein the surface of the magnet roller 3*b* has an electric energy supply electrode provided by electroconductivity treatment, and the charging magnetic particles are magnetically confined on the surface to form and support the magnetic brush portion, the magnet roller being rotated (rotatable magnet roller type). The present invention is applicable to a magnetic brush charger of non-rotatable type.

3. The charging of the image bearing member may be effected dominantly by the charge injection or dominantly by the discharge.

4. As for the image exposure means for electrostatic latent image formation, it is not limited to the laser scanning exposure means for forming a digital latent image as in the foregoing embodiments. It may be an usual analog image exposure means, or may use another light emission element such as LED. Fluorescent light emission element and liquid crystal shutter may be combined. It may be any one if it can form an electrostatic latent image corresponding to image information.

The image bearing member may by a dielectric member for electrostatic recording. In this case, the dielectric member surface is uniformly subjected to primary charging to a predetermined polarity and potential, and then, the surface is selectively discharged by discharging means such as discharging needle head, electronic gun or the like to form an intended electrostatic latent image.

5. The toner developing system for the electrostatic latent image may be any, and more particularly, it may be of reverse development type or of regular developing system.

6. The image transfer method is not limited to a roller transfer device as in the foregoing embodiments, it may be of a blade transfer type, another contact transfer charging type, or a non-contact type using a corona discharger. Furthermore, it may be a type wherein a transfer drum or transfer belt or intermediate transfer member is used for superimposing image transfer, multi-color image transfer, or full-color image transfer.

7. The electrophotographic photosensitive member and the electrostatic recording dielectric member as the image bearing member, may be a rotation belt type, on which a toner image is formed through charging, latent image formation and development. The toner image is displayed, and the belt is repeatedly used. The image forming apparatus includes such an image display device.

8. The magnetic brush charging device of the present invention is usable for any member to be charged by magnetic brush contact charging.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming a toner image on a recording material, said image forming means including an image bearing member for bearing a toner image, and charging means provided with a magnetic particle layer contactable to said image bearing member to charge said image bearing member; and determining means for determining an image forming condition of said image forming means, wherein the determinations are made in accordance with a density of toner returned from said charging means to said image bearing member.

2. An apparatus according to claim 1, wherein the image forming condition is a charging condition of said charging means.

3. An apparatus according to claim 2, further comprising means for supplying said charging means with an oscillating voltage, and wherein said determining means changes a peak-to-peak voltage of the oscillating voltage in accordance with the density of toner.

4. An apparatus according to any one of claims 1, 2 or 3, wherein said image forming means includes developing means for developing with the toner a latent image formed on said image bearing member, and said developing means removes residual toner from the image bearing member simultaneously with its developing operation.

5. An apparatus according to any one of claims 1, 2 or 3, wherein said bearing member has a surface layer having a volume resistivity of $1\times10^{10}$–$1\times10^{14}$ Ωcm.

6. An apparatus according to claim 5, wherein said image bearing member has a photosensitive layer inside said surface layer.

7. An image forming apparatus comprising:

image forming means for forming a toner image on a recording material, said image forming means including an image bearing member for bearing a toner image, and charging means provided with a magnetic particle layer contactable to said image bearing member to charge said image bearing member; and determining means for determining a discharging condition of a discharging operation for discharging the toner to said image bearing member from said charging means in accordance with a density of toner returned from said charging means to said image bearing member.

8. An apparatus according to claim 7, wherein said determining means determines whether to execute the discharging operation.

9. An apparatus according to claim 7, wherein said determining means changes an operation period of the discharging operation.

10. An apparatus according to claim 7, wherein said determining means changes a potential difference between a potential of said image bearing member to be charged by said charging means and a DC voltage applied to said charging means, in accordance with the density of toner.

11. An apparatus according to claim 7, further comprising means for supplying said charging means with an oscillating voltage, and wherein said determining means changes a peak-to-peak voltage of the oscillating voltage is accordance with the density of toner.

12. An apparatus according to any one of claims 7, 8, 9, 10 or 11, wherein said image forming means includes developing means for developing with the toner a latent image formed on said image bearing member, and said developing means removes residual toner from the image bearing member simultaneously with its developing operation.

13. An apparatus according to any one of claims 7, 8, 9, 10 or 11, wherein said image bearing member has a surface layer having a volume resistivity of $1\times10^{10}$–$1\times10^{14}$ Ωcm.

14. An apparatus according to claim 13, wherein said image bearing member has a photosensitive layer inside said surface layer.

15. An image forming apparatus comprising:

image forming means for forming a toner image on a recording material, said image forming means including an image bearing member for bearing a toner image, and charging means provided with a magnetic particle layer contactable to said image bearing member to charge said image bearing member; and determining means for determining a charging condition of said charging means, wherein the determinations are made in accordance with current through said charging means when said charging means is supplied with a predetermined voltage.

16. An apparatus according to claim 15, wherein said determining means determines when an image forming operation of said image forming means is to be prohibited in accordance with the current.

17. An apparatus according to claim 16, further comprising means for supplying said charging means with an oscillating voltage, and wherein said determining means changes a peak-to-peak voltage of the oscillating voltage in accordance with the current through said charging means.

18. An apparatus according to any one of claims 15, 16 or 17, wherein said image forming means includes developing means for developing with the toner a latent image formed on said image bearing member, and said developing means removes residual toner from the image bearing member simultaneously with its developing operation.

19. An apparatus according to any one of claims 15, 16 or 17, wherein said image bearing member has a surface layer having a volume resistivity of $1\times10^{10}$–$1\times10^{14}$ Ωcm.

20. An apparatus according to claim 19, wherein said image bearing member has a photosensitive layer inside said surface layer.

21. An image forming apparatus comprising:

image forming means for forming a toner image on a recording material, said image forming means including an image bearing member for bearing a toner image, and charging means provided with a magnetic particle layer contactable to said image bearing member to charge said image bearing member;

detecting means for optically detecting a toner amount in said magnetic particle layer; and determining means for determining an image forming condition of said image forming means and for determining when an image forming operation of said image forming means is to be prohibited, wherein the determinations are made in accordance with toner amount detected by said detected means.

22. An apparatus according to claim 21, wherein the image forming condition is a charging condition of said charging means.

23. An apparatus according to claim 22, further comprising means for supplying said charging means with an oscillating voltage, and wherein said determining means changes a peak-to-peak voltage of the oscillating voltage in accordance with the toner amount detected by said detecting means.

24. An apparatus according to any one of claims 21, 22 or 23, wherein said image forming means includes developing means for developing with the toner a latent image formed on said image bearing member, and said developing means removes residual toner from the image bearing member simultaneously with its developing operation.

25. An apparatus according to any one of claims 21, 22 or 23, wherein said image bearing member has a surface layer having a volume resistivity of $1\times10^{10}$–$1\times10^{14}$ Ωcm.

26. An apparatus according to claim 25, wherein said image bearing member has a photosensitive layer inside said surface layer.

27. An image forming apparatus comprising:

image forming means for forming a toner image on a recording material, said image forming means including an image bearing member for bearing a toner image, charging means provided with a magnetic particle layer contactable to said image bearing member to charge said image bearing member, and transferring means for transferring the toner image from said image bearing member onto the recording material; and determining means for determining a discharging condition of a discharging operation for discharging toner to said image bearing member from said charging means in accordance with an amount of residual toner on said image bearing member after image transfer operation of said transferring means.

28. An apparatus according to claim 27, wherein said determining means changes a potential difference between a potential of said image bearing member to be charged by said charging means and a DC voltage applied to said charging means, in accordance with the amount of residual toner.

29. An apparatus according to claim 27, further comprising means for supplying said charging means with an oscillating voltage, and wherein said determining means changes a peak-to-peak voltage of the oscillating voltage is accordance with the amount of residual toner.

30. An apparatus according to any one of claims 27, or 28, wherein said image forming means includes developing means for developing with the toner a latent image formed on said image bearing member, and said developing means removes residual toner from the image bearing member simultaneously with its developing operation.

31. An apparatus according to any one of claims 27, 28 or 29, wherein said image bearing member has a surface layer having a volume resistivity of $1\times10^{10}$–$1\times10^{14}$ Ωcm.

32. An apparatus according to claim 31, wherein said image bearing member has a photosensitive layer inside said surface layer.

33. An image forming apparatus comprising:

image forming means for forming a toner image on a recording material, said image forming means including an image bearing member for bearing a toner image, charging means provided with a magnetic particle layer contactable to said image bearing member to charge said image bearing member, and latent image forming means for forming a latent image on said image bearing member in accordance with image data; and determining means for determining a discharging condition of a discharging operation for discharging the toner to said image bearing member from said charging means in accordance with the image data.

34. An apparatus according to claim 33, wherein said determining means changes a potential difference between a potential of said image bearing member to be charged by said charging means and a DC voltage applied to said charging means, in accordance with the image data.

35. An apparatus according to claim 33, further comprising means for supplying said charging means with an oscillating voltage, and wherein said determining means changes a peak-to-peak voltage of the oscillating voltage is accordance with the image data.

36. An apparatus according to any one of claims 33, 34 or 35, wherein said image forming means includes developing means for developing with the toner a latent image formed on said image bearing member, and said developing means removes residual toner from the image bearing member simultaneously with its developing operation.

37. An apparatus according to any one of claims 33, 34 or 35, wherein said image bearing member has a surface layer having a volume resistivity of $1\times10^{10}$–$1\times10^{14}$ Ωcm.

38. An apparatus according to claim 37, wherein said image bearing member has a photosensitive layer inside said surface layer.

39. An image forming apparatus comprising:

image forming means for forming a toner image on a recording material, said image forming means including an image bearing member for bearing a toner image, charging means provided with a magnetic particle layer contactable to said image bearing member to charge said image bearing member; and determining means for determining a discharging condition of discharging operation for discharging the toner to said image bearing member from said charging means in accordance with current through said charging means when said charging means is supplied with a predetermined voltage.

40. An apparatus according to claim 39, wherein said determining means changes a potential difference between a potential of said image bearing member to be charged by said charging means and a DC voltage applied to said charging means, in accordance with the current through said charging means.

41. An apparatus according to claim 39, further comprising means for supplying said charging means with an oscillating voltage, and wherein said determining means changes a peak-to-peak voltage of the oscillating voltage is accordance with the current through said charging means.

42. An apparatus according to any one of claims 39, 40 or 41, wherein said image forming means includes developing means for developing with the toner a latent image formed on said image bearing member, and said developing means removes residual toner from the image bearing member simultaneously with its developing operation.

43. An apparatus according to any one of claims 39, 40 or 41, wherein said image bearing member has a surface layer having a volume resistivity of $1\times10^{10}$–$1\times10^{14}$ Ωcm.

44. An apparatus according to claim 43, wherein said image bearing member has a photosensitive layer inside said surface layer.

45. An image forming apparatus comprising:

image forming means for forming a toner image on a recording material, said image forming means including an image bearing member for bearing a toner image, and charging means provided with a magnetic particle layer contactable to said image bearing member to charge said image bearing member;

detecting means for optically detecting a toner amount in said magnetic particle layer; and determining means for determining a discharging condition of a discharging operation for discharging the toner to said image bearing member from said charging means in accordance with the toner amount detected by said detecting means.

46. An apparatus according to claim 45, wherein said determining means changes a potential difference between a potential of said image bearing member to be charged by said charging means and a DC voltage applied to said charging means, in accordance with the toner amount detected by said detecting means.

47. An apparatus according to claim 45, further comprising means for supplying said charging means with an oscillating voltage, and wherein said determining means changes a peak-to-peak voltage of the oscillating voltage is accordance with the toner amount detected by said detecting means.

48. An apparatus according to any one of claims 45, 46 or 47, wherein said image forming means includes developing means for developing with the toner a latent image formed on said image bearing member, and said developing means removes residual toner from the image bearing member simultaneously with its developing operation.

49. An apparatus according to any one of claims 45, 46 or 47, wherein said image bearing member has a surface layer having a volume resistivity of $1\times10^{10}$–$1\times10^{14}$ Ωcm.

50. An apparatus according to claim 49, wherein said image bearing member has a photosensitive layer inside said surface layer.

51. An image forming apparatus comprising:

image forming means for forming a toner image on a recording material, said image forming means including an image bearing member for bearing a toner image, and charging means provided with a magnetic particle layer contactable to said image bearing member to charge said image bearing member; and determining means for determining when an image forming operation of said image forming means is to be prohibited, wherein the determinations are made in accordance with a density of toner returned from said charging means to said image bearing member.

52. An apparatus according to claim 51, wherein said image forming means includes developing means for developing with the toner a latent image formed on said image bearing member, and said developing means removes residual toner from the image bearing member simultaneously with its developing operation.

53. An apparatus according to claim 51, wherein said image bearing member has a surface layer having a volume resistivity of $1\times10^{10}$–$1\times10^{14}$ Ωcm.

54. An image forming apparatus comprising:

image forming means for forming a toner image on a recording material, said image forming means including an image bearing member for bearing a toner image, charging means provided with a magnetic particle layer contactable to said image bearing member to charge said image bearing member, and transferring means for transferring the toner image from said image bearing member onto the recording material; and determining means for determining when an image forming operation of said image forming means is to be prohibited, wherein the determinations are made in accordance with an amount of residual toner on said image bearing member after image transfer operation of said transferring means.

55. An apparatus according to claim 54, wherein said image forming means includes developing means for developing with the toner a latent image formed on said image bearing member, and said developing means removes residual toner from the image bearing member simultaneously with its developing operation.

56. An apparatus according to claim 54, wherein said image bearing member has a surface layer having a volume resistivity of $1\times10^{10}$–$1\times10^{14}$ Ωcm.

* * * * *

UNITED STATES PATENT AND TRADEMARK OFFICE

CERTIFICATE OF CORRECTION

PATENT NO. : 6,118,952

DATED : September 12, 2000

INVENTOR(S): TADASHI FURUYA

It is certified that error appears in the above-identified patent and that said Letters Patent is hereby corrected as shown below:

COLUMN 2:
Line 44, "Invention" should read --invention--.

COLUMN 4:
Line 18, "of(remaining image)." should read --remaining image--; and
Line 52, "current(a" should read --current (a--.

COLUMN 6:
Line 3, "returns" should read --return--.

COLUMN 9:
Line 8, "In" should read --in--.

COLUMN 10:
Line 44, "a" should read --an--.

COLUMN 11:
Line 17, "material. P" should read --material P--.

COLUMN 13:
Line 49, "variations." should read --varies--.

COLUMN 14:
Line 8, "decrease" should be deleted;
Line 20, "change d" should read --changed--; and
Line 21, "shown" should read --shown in--.

COLUMN 19:
Line 59, "is" should read --in--.

UNITED STATES PATENT AND TRADEMARK OFFICE

CERTIFICATE OF CORRECTION

PATENT NO. : 6,118,952

DATED : September 12, 2000

INVENTOR(S): TADASHI FURUYA

It is certified that error appears in the above-identified patent and that said Letters Patent is hereby corrected as shown below:

COLUMN 21:
Line 32, "is" should read --in--.

COLUMN 22:
Line 2, "is" should read --in--; and
Line 37, "is" should read --in--.

COLUMN 23:
Line 8, 'is" should read --in--.

Signed and Sealed this

First Day of May, 2001

*Attest:*

Nicholas P. Godici

NICHOLAS P. GODICI

*Attesting Officer*

*Acting Director of the United States Patent and Trademark Office*